US008528262B2

(12) United States Patent
Horton et al.

(10) Patent No.: US 8,528,262 B2
(45) Date of Patent: Sep. 10, 2013

(54) GUTTER-LOCKING GUTTER PROTECTION

(75) Inventors: James W. Horton, Yulee, FL (US); Russell Verbrugge, Holland, MI (US); Robert Heilman, Byron Center, MI (US); David Skelton, Bartlett, TN (US); Hal Klaus, Highland, IL (US)

(73) Assignee: Southeastern Metals Manufacturing Company, Inc.

( * ) Notice: Subject to any disclaimer, the term of this patent is extended or adjusted under 35 U.S.C. 154(b) by 176 days.

(21) Appl. No.: 12/952,271

(22) Filed: Nov. 23, 2010

(65) Prior Publication Data

US 2011/0283630 A1 Nov. 24, 2011

Related U.S. Application Data

(63) Continuation-in-part of application No. 10/904,988, filed on Dec. 8, 2004, now Pat. No. 7,861,980, and a continuation-in-part of application No. 12/573,130, filed on Oct. 4, 2009.

(60) Provisional application No. 61/104,866, filed on Oct. 13, 2008, provisional application No. 61/151,489, filed on Feb. 10, 2009.

(51) Int. Cl.
*E04D 13/00* (2006.01)

(52) U.S. Cl.
USPC ..... 52/12; 52/11; 248/48.1; 248/48.2

(58) Field of Classification Search
USPC ..... 52/11, 12; 248/48.1, 48.2
See application file for complete search history.

(56) References Cited

U.S. PATENT DOCUMENTS

| | | | | |
|---|---|---|---|---|
| 3,436,878 | A * | 4/1969 | Singer | 52/12 |
| 4,418,504 | A | 12/1983 | Lassiter | |
| 4,941,299 | A * | 7/1990 | Sweers | 52/12 |
| 5,010,696 | A * | 4/1991 | Knittel | 52/12 |
| 5,271,192 | A * | 12/1993 | Nothum et al. | 52/12 |
| 5,842,311 | A * | 12/1998 | Morin | 52/12 |
| 6,598,352 | B2 * | 7/2003 | Higginbotham | 52/12 |
| 6,951,077 | B1 * | 10/2005 | Higginbotham | 52/12 |
| 7,143,549 | B2 * | 12/2006 | Brochu | 52/12 |
| 7,174,688 | B2 * | 2/2007 | Higginbotham | 52/672 |

(Continued)

OTHER PUBLICATIONS

Gutter Oportunities, A supplement to Metal Roofing, p. 21, dated Summer 2006.

(Continued)

*Primary Examiner* — Brian Glessner
*Assistant Examiner* — Adriana Figueroa
(74) *Attorney, Agent, or Firm* — Jennifer Meredith, Esq.; Lippes Mathias Wexler Friedman LLP

(57) ABSTRACT

System, device and method for providing screened protection to gutters from clogging debris. Protection is provided by using a panel that includes rain siphoning louvered technology. The louvers may be covered by a filter or screen. If the openings of the louvers are closed to a certain degree, a screen may be dispensed with. The panel is sloped such that debris rolls off a surface of the panel. Additionally, the louvered portion may be domed. The panel ends on one side in a locking mechanism that locks to an outer lip of the gutter and on the other side in a corrugated edge that fits under the overhang of the roof such that it need not be inserted under the shingles.

19 Claims, 32 Drawing Sheets

(56) References Cited

U.S. PATENT DOCUMENTS

| | | | | |
|---|---|---|---|---|
| 8,037,641 | B2 * | 10/2011 | Gerig | 52/12 |
| 2005/0204642 | A1 * | 9/2005 | Valentini | 52/12 |
| 2009/0056234 | A1 * | 3/2009 | Brochu | 52/12 |
| 2009/0090067 | A1 * | 4/2009 | Demartini | 52/12 |

OTHER PUBLICATIONS

Mastershield advertisement, Qualified Remodeler, p. 51, dated Sep. 2005.

Mastershield advertisement, copyright 2005.

Grater gutter guard, purported to be dated May 18, 2006.

* cited by examiner

Method for making a screened gutter protection system

Gutter protection method

4001

4002

6801
6805
6817
6815

6820
6830
6803

Roof edge end
Gutter edge end

GUTTER-LOCKING GUTTER PROTECTION

CROSS-REFERENCE TO RELATED APPLICATIONS

The present application is a continuation-in-part of, and claims priority to and the benefit of the U.S. patent applications Ser. No. 10/904,988, filed in the United States Patent and Trademark Office on Dec. 8, 2004 and titled "Hanger for Rain Gutter Device," and Ser. No. 12/573,130 filed on Oct. 4, 2009 and titled "Screened Gutter Protection," which in turn claimed priority to and the benefit of the U.S. Provisional Patent Applications Ser. No. 61/104,866 and No. 61/151,489, filed respectively on Oct. 10, 2008, and Feb. 19, 2009, the entire content of all of which is incorporated by this reference.

BACKGROUND OF THE INVENTION

1. Field of the Invention

The invention relates generally to covers that direct water run-off from a roof of a building to a rain gutter while preventing debris from entering the rain gutter, and more particularly, to hanger brackets that mount such covers to a building. The present invention further pertains generally to the field of gutters and, more particularly, to gutter covers for protecting gutters from collection of debris.

2. Description of Related Art

Gutter debris has the potential to clog the gutters and presents various problems. Obstructed gutters and downspouts prevent rain water and melting snow from flowing through the gutter system. Water that cannot flow freely can back-up and overflow the gutter causing damage to the landscaping and the foundation. Damage to the roof line and the fascia board may also occur if water gets behind the gutter. Cleaning of the gutters from ladders or by climbing on the roof is dangerous.

A variety of devices have been employed to prevent debris such as leaves and twigs from entering a gutter system. Such debris can clog the gutter preventing water from being properly diverted and over time can cause deterioration of the gutter and the fascia to which the gutter is typically mounted. The prior known gutter covers have included everything from simple screens placed over the top of the gutter to complex devices designed to slow the water flow to ensure entry into the gutter while expelling debris over the outside edge of the gutter.

One of the best operating gutter covers is the Gutter Helmet® cover as substantially disclosed in U.S. Pat. No. 4,404,775. Gutter Helmet® is a registered trademark of Southeastern Metals Mfg. Co., 11801 Industry Drive, Jacksonville, Fla. 32218, USA. This cover is secured to the roof proximate the gutter such that rainwater flows from the roof onto the gutter cover. The cover includes a radiused outer nose which is positioned over the outer edge of the gutter to ensure that debris is expelled beyond the outer edge. Meanwhile, the radiused nose is designed to direct water into the gutter. The surface tension of the water flowing across the cover causes the flow to follow the radiused nose into the gutter.

Various hanger brackets have been developed to support such gutter covers, which support becomes more important in geographical areas where snow, ice, and high winds place extreme loads on gutter covers. Examples of such hanger brackets can be found in U.S. Pat. Nos. 4,796,390 and 4,497,146 to Demartini, and in U.S. Pat. No. 5,737,879 to Sweet. There remains a need for a hanger bracket that enables easier installation and provides greater strength against extreme loads.

BRIEF SUMMARY OF THE INVENTION

Gutter protection devices are needed to help maintain a clean, free flowing gutter and reduce the time spent on ladders and the risk associated with working from a ladder. Aspects of the present invention provide methods, devices and systems for protecting gutters from collection of debris and the problems that are associated with clogging of the gutters by the collected debris.

Hanger Bracket

According to some aspects of the present invention a bracket for affixing a rainwater deflector over a rain gutter on a building comprises a long arm, a short arm extending from a junction with and generally normally relative to the long arm, and a gutter support flange extending at an acute angle from an end of the short arm. All have at least one depending flange to strengthen the bracket against bending. Preferably, the long arm, short arm and gutter support flange each have two oppositely disposed depending flanges. Also, the bracket can have one or more longitudinal ribs on the long arm.

In another aspect of the invention, a bracket assembly for affixing a rainwater deflector over a rain gutter on a building includes a bracket having a long arm, a short arm extending from a junction with and generally normally relative to the long arm, and a gutter support flange extending at an acute angle from an end of the short arm. All have centerlines lying in an imaginary plane. The assembly also includes a brace having a centerline, where the brace is mountable to and between the long arm and the short arm with the brace centerline lying in the imaginary plane. The long arm has at least one tab located on one side of the imaginary plane for holding a rainwater deflector. The short arm has a mounting hole on the other side of the imaginary plane. Thus, the mounting hole can be easily accessed to extend a fastener through it to a fascia on the building after affixing a panel of the rainwater deflector to the tabs. Preferably, the long arm has three tabs on the one side of the imaginary plane. Also, the brace can have one or more mounting holes to receive the fastener. If more than one, any one of them can be selected to receive the fastener.

In yet another aspect of the invention, a bracket for affixing a rainwater deflector over a rain gutter on a building comprises a long arm, a short arm extending from a junction with and generally normally relative to the long arm, and a gutter support flange extending at an acute angle from an end of the short arm. The long arm has at least two channels for receiving and supporting a heater cable. Preferably, one channel is at the junction and another channel is intermediate the junction and the distal end of the long arm. A tab can extend from the junction adjacent the channel.

Finally, a bracket for affixing a rainwater deflector over a rain gutter on a building, comprises a long arm, a short arm extending from a junction with and generally normally relative to the long arm, and a gutter support flange extending at an acute angle from an end of the short arm. The gutter support flange has an inturned ledge adapted to capture and retain a lip of a gutter without fasteners.

Aspects of the present invention provide a bracket for affixing a rainwater deflector over a rain gutter on a building. The bracket comprises a long arm, a short arm extending from a junction with and generally normally relative to the long arm, and a gutter support flange extending at an acute angle from an end of the short arm, all having at least one depending flange to strengthen the bracket against bending. The long arm, short arm and gutter support flange may each have two oppositely disposed depending flanges. The bracket may further comprise at least one longitudinal rib on the long arm.

The bracket may further comprise a gripping tab on the short arm whereby the rainwater deflector can be held to the bracket against wind force tending to lift it up.

Aspects of the present invention provide a bracket assembly for affixing a rainwater deflector over a rain gutter on a building. The bracket assembly comprises a bracket having a long arm, a short arm extending from a junction with and generally normally relative to the long arm, and a gutter support flange extending at an acute angle from an end of the short arm, all having centerlines lying in an imaginary plane, and a brace having a centerline, wherein the brace is mountable to and between the long arm and the short arm with the brace centerline lying in the imaginary plane, the long arm having at least one tab located on one side of the imaginary plane for holding a rainwater deflector, and the short arm having a mounting hole on the other side of the imaginary plane, whereby the mounting hole can be easily accessed to extend a fastener through it to a fascia on the building after affixing a panel of the rainwater deflector to the tabs. In the bracket assembly, the long arm may have three tabs on the one side of the imaginary plane. In the bracket assembly, the brace may have at least one mounting hole to receive the fastener. In the bracket assembly the brace may have three mounting holes, any one of which can be selected to receive the fastener.

Aspects of the present invention provide a bracket for affixing a rainwater deflector over a rain gutter on a building. The bracket comprises a long arm, a short arm extending from a junction with and generally normally relative to the long arm, and a gutter support flange extending at an acute angle from an end of the short arm, wherein the long arm has at least two channels for receiving and supporting a heater cable. In the bracket one channel may be at the junction and another channel may be intermediate the junction and distal end of the long arm. The bracket may further comprise a tab extending from the junction adjacent the one channel. The bracket may further comprise a gripping tab on the short arm whereby the rainwater deflector can be held to the bracket against wind force tending to lift it up.

Aspects of the present invention provide a bracket for affixing a rainwater deflector over a rain gutter on a building, that comprises a long arm, a short arm extending from a junction with and generally normally relative to the long arm, and a gutter support flange extending at an acute angle from an end of the short arm, wherein the gutter support flange has an inturned ledge adapted to capture and retain a lip of a gutter without fasteners. The bracket may further comprise a gripping tab on the short arm whereby the rainwater deflector can be held to the bracket against wind force tending to lift it up.

Aspects of the present invention provide a bracket for affixing a rainwater deflector over a rain gutter on a building. The bracket comprises a long arm, a short arm extending from a junction with and generally perpendicular relative to said long arm, a gutter support flange extending at an acute angle from an end of the short arm, said gutter support flange having at least one depending flange to strengthen the bracket against bending, an outwardly and downwardly extending gripping tab in said short arm beneath said junction, wherein said gripping tab on said short arm holds a rainwater deflector to said bracket, and an outwardly and upwardly extending trapping tab in said short arm beneath said junction for trapping the rainwater deflector, wherein the long arm is mounted on the surface of building.

Aspects of the present invention provide a bracket for affixing a rainwater deflector over a rain gutter on a building. The bracket includes a long arm, wherein said long arm has at least two channels for receiving and supporting a heater cable, a short arm extending from a junction with and generally perpendicular relative to said long arm, a gutter support flange extending at an acute angle from an end of the short arm, said gutter support flange having at least one depending flange to strengthen the bracket against bending, an outwardly and downwardly extending gripping tab in said short arm beneath said junction for holding the rainwater deflector, and an outwardly and upwardly extending trapping tab in said short arm beneath said junction for trapping the rainwater deflector, wherein the long arm is mounted on the surface of building.

Aspects of the present invention provide a bracket for affixing a rainwater deflector over a rain gutter on a building. The bracket includes a long arm, wherein said long arm has at least two channels for receiving and supporting a heater cable, a short arm extending from a junction with and generally perpendicular relative to said long arm, wherein at least one of said at least two channels is at said junction and another channel is intermediate the junction and distal end of said long arm, a gutter support flange extending at an acute angle from an end of the short arm, said gutter support flange having at least one depending flange to strengthen the bracket against bending, an outwardly and downwardly extending gripping tab in said short arm beneath said junction for holding the rainwater deflector, and an outwardly and upwardly extending trapping tab in said short arm beneath said junction for trapping the rainwater deflector, wherein the long arm is mounted on the surface of building.

Aspects of the present invention provide a bracket for affixing a rainwater deflector over a rain gutter on a building. The bracket includes a long arm, wherein said long arm has at least two channels for receiving and supporting a heater cable, a short arm extending from a junction with and generally perpendicular relative to said long arm, a gutter support flange extending at an acute angle from an end of the short arm, said gutter support flange having at least one depending flange to strengthen the bracket against bending, an outwardly and downwardly extending gripping tab in said short arm beneath said junction for holding the rainwater deflector, an outwardly and upwardly extending trapping tab in said short arm beneath said junction for trapping the rainwater deflector, and a tab extending from said junction adjacent at least one of the at least two channels, wherein the long arm is mounted on the surface of building.

Aspects of the present invention provide a bracket for affixing a rainwater deflector over a rain gutter on a building. The bracket includes a long arm, a short arm extending from a junction with and generally perpendicular relative to said long arm, a gutter support flange extending at an acute angle from an end of the short arm, said gutter support flange having at least one depending flange to strengthen the bracket against bending, an outwardly and downwardly extending gripping tab in said short arm beneath said junction, an outwardly and upwardly extending trapping tab in said short arm beneath said junction, a rainwater deflector in communication with said gripping tab, whereby said rainwater deflector can be held to said bracket against wind force tending to lift it up wherein the trapping tab traps the rainwater deflector, wherein the long arm is mounted on the surface of building.

Aspects of the present invention provide a bracket for affixing a rainwater deflector over a rain gutter on a building. The bracket includes a long arm, a short arm extending from a junction with and generally perpendicular relative to said long arm, a gutter support flange extending at an acute angle from an end of the short arm, said gutter support flange having at least one depending flange to strengthen the bracket against bending, an outwardly and downwardly extending gripping tab in said short arm beneath said junction for holding the rainwater deflector, an outwardly and upwardly extending trapping tab in said short arm beneath said junction for trapping the rainwater deflector, at least one mounting hole in said short arm to receive a fastener, whereby said mounting hole can be easily accessed to extend a fastener through it to a fascia on the building after affixing a panel of the rainwater deflector to said tabs.

Aspects of the present invention provide a bracket for affixing a rainwater deflector over a rain gutter on a building. The bracket includes a long arm, a short arm extending from a junction with and generally perpendicular relative to said long arm, a gutter support flange extending at an acute angle from an end of the short arm, said gutter support flange having at least one depending flange to strengthen the bracket against bending, an outwardly and downwardly extending gripping tab in said short arm beneath said junction for holding the rainwater deflector, an outwardly and upwardly extending trapping tab in said short arm beneath said junction for trapping the rainwater deflector, a brace mountable to and between said long arm and said short arm further includes at least two mounting holes in said brace, any one of which can be selected to receive a fastener, wherein the long arm is mounted on the surface of building.

Aspects of the present invention provide a bracket for affixing a rainwater deflector over a rain gutter on a building. The bracket includes a long arm, a short arm extending from a junction with and generally perpendicular relative to said long arm, a gutter support flange extending at an acute angle from an end of the short arm, said gutter support flange having at least one depending flange to strengthen the bracket against bending, a brace mountable to and between said long arm and said short arm, wherein said long arm, said short arm, said gutter support flange and said brace each have centerlines lying in an invisible plane, an outwardly and downwardly extending gripping tab in said short arm beneath said junction, and an outwardly and upwardly extending trapping tab in said short arm beneath said junction, wherein said gripping tab in said short arm holds a rainwater deflector to said bracket wherein the trapping tab traps the rainwater deflector, wherein the long arm is mounted on the surface of building.

Aspects of the present invention provide a bracket for affixing a rainwater deflector over a rain gutter on a building. The bracket includes a long arm having at least two channels for receiving and supporting a heater cable, a short arm extending from a junction with and generally perpendicular relative to said long arm, a gutter support flange extending at an acute angle from an end of the short arm, all having the gutter support flange having at least one depending flange to strengthen the bracket against bending, a brace mountable to and between said long arm and said short arm, wherein said long arm, said short arm, said gutter support flange and said brace each have centerlines lying in an invisible plane, an outwardly and downwardly extending gripping tab in said short arm beneath said junction.

Aspects of the present invention provide a bracket for affixing a rainwater deflector over a rain gutter on a building. The bracket includes a long arm having at least two channels, a short arm extending from a junction with and generally perpendicular relative to said long arm, a gutter support flange extending at an acute angle from an end of the short arm, all having the gutter support flange having at least one depending flange to strengthen the bracket against bending, a brace mountable to and between said long arm and said short arm, wherein said long arm, said short arm, said gutter support flange and said brace each have centerlines lying in an invisible plane, and an outwardly and downwardly extending gripping tab in said short arm beneath said junction wherein said long arm, wherein at least one of said at least two channels is at said junction and another channel is intermediate the junction and distal end of the long arm, wherein the long arm is mounted on the surface of building.

Aspects of the present invention provide a bracket for affixing a rainwater deflector over a rain gutter on a building. The bracket includes bracket for affixing a rainwater deflector over a rain gutter on a building, includes a long arm having at least two channels, a short arm extending from a junction with and generally perpendicular relative to said long arm, a gutter support flange extending at an acute angle from an end of the short arm, said gutter support flange having at least one depending flange to strengthen the bracket against bending, a brace mountable to and between said long arm and said short arm, wherein said long arm, said short arm, said gutter support flange and said brace each have centerlines lying in an invisible plane, an outwardly and downwardly extending gripping tab in said short arm beneath said junction wherein said long arm, and a tab extending from said junction adjacent at least one of said at least two channels, wherein the long arm is mounted on the surface of building.

Gutter Protection System

In one aspect of the present invention, protection for the gutter from clogging debris is provided by using a panel that includes rain siphoning louvered technology covered by a filter, screen or a filter screen. The louvers include substantially vertical openings. The vertical openings are vertical to a surface of the panel and lead to horizontal openings as opposed to being openings merely on the surface of the panel. Vertical openings are less susceptible to the penetration of debris. The rows of louvers may be offset to direct water around the louvers and into the openings. The louvered portion is dome shaped to permit the louvers to be substantially vertical and also to help debris roll off the sides of the panel. The filter, screen or filter screen may be made from a stainless steel micro mesh and is molded to the rows of louvers to conduct water to the vertical openings of the louvers. The filter, screen or filter screen may be secured to the panel by being laid into hems on the two opposing sides of the louvered portion of the panel to obtain hemmed portions. Accordingly, the securing of the filter to the panel is obtained without using glue. Moreover, the filter may be further secured to the hems in the panel by rolling ribs onto the hemmed portions. On one side, the panel may end in alignment ribs that are used to align the gutter protection system under the roofing material.

One aspect of the present invention provides a system for protection of a gutter from debris collection. The system includes a panel, and a screen connected to the panel. The panel includes louvers in a louvered portion of the panel, and the louvers provide openings to the gutter below. The openings are substantially vertical with respect to a panel surface, and the screen is molded over the louvers. The panel may include an outer portion fitting over a lip of the gutter, a first hemmed portion for connecting a first edge of the screen to the panel and extending from the outer portion, the louvered portion extending from the first hemmed portion, a second hemmed portion for connecting a second edge of the screen to the panel and extending from the louvered portion, and an extension portion of the panel for fitting the panel on a roof and extending from the second hemmed portion. The panel may be made from a continuous sheet, and beads may be rolled onto the first hemmed portion and the second hemmed portion. The louvers may be arranged in offset rows of louvers. The extension portion of the panel may include alignment ribs for mounting the panel on a fascia. The louvered portion of the panel may be dome-shaped and the screen may be convex. The system may be installed at an angle with respect to horizontal to facilitate rolling off of debris. The panel may be made from metal and the screen may be stainless steel.

In one aspect, the present invention provides a screened gutter protection device for being mounted on a roof and fitting over a gutter and for protecting the gutter from collection of debris. The device includes a panel including louvers, the louvers having openings being substantially vertical with respect to panel surface, and a filter screen set in hemmed portions on opposing sides of the panel and secured to the panel by rolled screen locking beads at the hemmed portions. The filter screen is molded over the louvers. The louvers are formed in a louvered portion of the panel and the panel may be dome shaped in the louvered portion and the filter screen is convex, and the louvers may be arranged in offset rows of louvers. The panel may include an outer portion for fitting over an outer lip of the gutter, a first rolled screen locking bead for holding a first edge of the filter screen to the panel and extending from the outer portion, a louvered portion of the panel including the louvers and extending from the first rolled screen locking bead, a second rolled screen locking bead for holding a second edge of the filter screen to the panel and extending from the louvered portion, and a ribbed extension adapted for fitting over a roof and extending from the second rolled screen locking bead. The panel may be made from a continuous sheet of material that is made from heavy gauge 0.024 aluminum and is coated with paint. The filter screen may be made from stainless steel micro mesh.

One aspect of the present invention provides a method for making a screened gutter protection system. The method includes forming a panel, and attaching a screen to the panel. The panel may be formed by forming an outer portion for fitting over an outer lip of a gutter, a first hemmed portion for holding a first edge of the screen to the panel and connected to the outer portion, louvers having openings substantially vertical to a surface of the panel in a louvered portion of the panel being connected to the first hemmed portion, a second hemmed portion for holding a second edge of the screen to the panel and connected to the first rolled screen, and a ribbed extension adapted for fitting over a roof and connected to the second hemmed portion. The method may further include molding the screen to the louvered portion of the panel. The attaching of the screen to the panel may include laying a first side of the screen in the first hemmed portion and a second side of the screen in the second hemmed portion, and rolling beads onto the hemmed portions. The panel may be formed from a continuous sheet of material. The panel may be dome shaped in the louvered portion and the filter screen is convex, and the louvers are arranged in offset rows of louvers.

One aspect of the present invention provides a method of installing a gutter protection system for a gutter. The method includes determining a type and a size of the gutter, determining a required number of gutter protection components, and installing the gutter protection components to form the gutter protection system. The gutter protection system includes a panel including louvers, the louvers having openings being substantially vertical with respect to panel surface, and a filter screen set in hemmed portions on opposing sides of the panel and secured to the panel by rolled screen locking beads at the hemmed portions, wherein the filter screen is molded over the louvers.

Gutter-Locking Gutter Protection System

Aspects of the present invention provide a system for protection of a gutter from debris collection. The system includes a panel extending from an edge of a roof to an outer lip of the gutter installed around the edge of the roof. The panel includes a louvered portion including louvers for providing openings to the gutter below, a corrugated edge adapted for fitting under the edge of the roof and lying substantially parallel to the edge of the roof upon installation, the corrugated edge being further adapted for fitting over an inner lip of the gutter, a gutter lock for locking the panel to the outer lip of the gutter, and a connecting portion leading from the louvered portion to the corrugated edge. The connecting portion is adapted for being bent to form a substantially right angle with the corrugated portion, and the connecting portion is adapted for being bent to form an angle with the louvered portion upon the installation of the panel over the gutter. A surface of the louvered portion may be substantially sloped downward from the edge of the roof toward the outer lip of the gutter. The gutter lock may include a bracket for affixing the panel over the gutter. A bracket described above may be used. The openings in the louvered portion are considered to be 100% open when the openings are substantially vertical with respect to a panel surface, and the openings in the louvered portion may be between 50% and 99% closed with respect to the panel surface. A screen may be connected to the panel and molded over the louvered portion. The panel may further include a first hemmed portion for connecting a first edge of the screen to the panel, and a second hemmed portion for connecting a second edge of the screen to the panel, where the panel is made from a continuous sheet, and beads are rolled onto the first hemmed portion and the second hemmed portion. The screen may be made from 40/40 stainless steel screen mesh and the panel is made from 7.5" coil. The louvers may be arranged in offset rows of louvers. The system of louvered portion of the panel may be dome-shaped. The corrugated edge may be adapted for locking to fascia on top of the gutter for both 5K and 6K gutters.

Aspects of the present invention provide a screened gutter protection device for being mounted on a roof and fitting over a gutter on a roof and for protecting the gutter from collection of debris. The device includes a panel including louvers, the louvers having openings in a louvered portion of the panel, and a filter screen set in hemmed portions on opposing sides of the panel and secured to the panel by rolled screen locking beads at the hemmed portions. The panel includes a corrugated edge adapted for fitting under an edge of the roof and lying substantially parallel to the edge of the roof upon installation, the corrugated edge being further adapted for fitting over an inner lip of the gutter, a gutter lock for locking the panel to the outer lip of the gutter, and a connecting portion leading from the louvered portion to the corrugated edge. The connecting portion is adapted for being bent to form a first angle with the corrugated portion and a second angle with the louvered portion upon the installation of the panel over the gutter. A surface of the panel may slope from the edge of the roof downward to the outer lip of the gutter. The panel may further includes a first rolled screen locking bead for holding a first edge of the filter screen to the panel, and a second rolled screen locking bead for holding a second edge of the filter screen to the panel. The panel may be dome shaped in the louvered portion and the filter screen may be convex, the louvers may be arranged in offset rows of louvers, the filter screen may be fitted over the louvered portion and the panel may be made from a continuous sheet of material and the filter screen from stainless steel micro mesh.

Aspects of the present invention provide a method for making a screened gutter protection system. The method includes forming a panel, and attaching a screen to the panel. The panel extends from an edge of a roof to an outer lip of the gutter installed around the edge of the roof, and the panel is formed by including a louvered portion having louvers for providing openings to the gutter below, a corrugated edge adapted for fitting under the edge of the roof and lying substantially parallel to the edge of the roof upon installation, the corrugated edge being further adapted for fitting over an inner lip of the gutter, a gutter lock for locking the panel to the outer lip of the gutter, and a connecting portion leading from the louvered portion to the corrugated edge. The connecting portion is adapted for being bent to form angles with the corrugated portion and the louvered portion upon installation of the panel over the gutter. The method may further include molding the screen to the louvered portion of the panel. The attaching of the screen to the panel may include laying a first side of the screen in a first hemmed portion of the panel and a second side of the screen in a second hemmed portion of the panel, and rolling beads onto the hemmed portions. The panel may be formed from a continuous sheet of material. The panel may be dome shaped in the louvered portion and the filter screen is convex, and the louvers may be arranged in offset rows of louvers.

Aspects of the present invention provide a method of installing a gutter protection system for a gutter. The method includes determining a type and a size of the gutter, determining a required number of gutter protection components, and installing the gutter protection components to form the gutter protection system. The gutter protection system includes a panel extending from an edge of a roof to an outer lip of the gutter installed around the edge of the roof, the panel including a louvered portion including louvers for providing openings to the gutter below, a corrugated edge adapted for fitting under the edge of the roof and lying substantially parallel to the edge of the roof upon installation, the corrugated edge being further adapted for fitting over an inner lip of the gutter, a gutter lock for locking the panel to the outer lip of the gutter, and a connecting portion leading from the louvered portion to the corrugated edge. The connecting portion is adapted for being bent to form angles with the corrugated portion and the louvered portion upon the installation of the panel over the gutter.

DETAILED DESCRIPTION OF THE INVENTION

Hanger-Bracket

Figure 1:
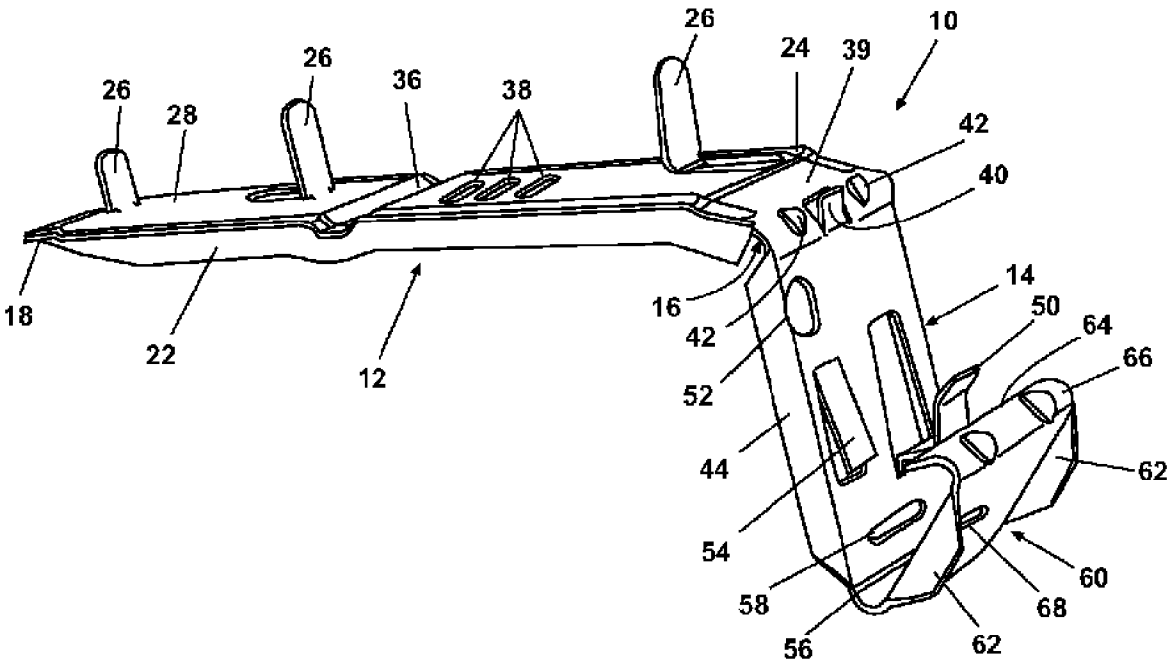
FIG. 1 is a perspective view of a first embodiment of a hanger bracket according to the invention.
Figure 2:
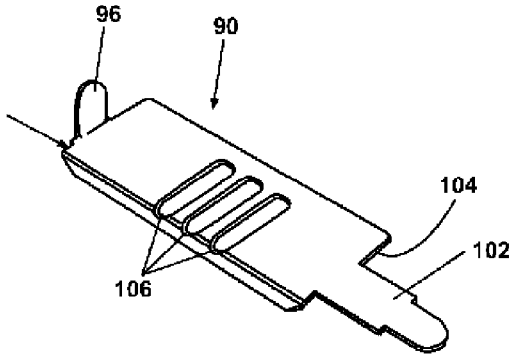
FIG. 2 is a perspective view of an optional brace that can be used with the hanger bracket of FIG. 1.
Figure 3:
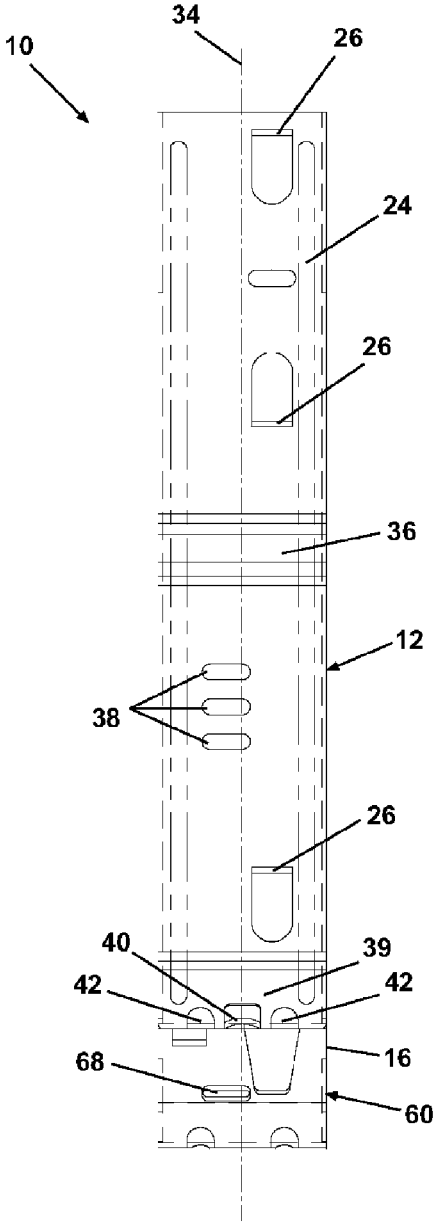
FIG. 3 is a top plan view of the hanger bracket of FIG. 1.
Figure 4:
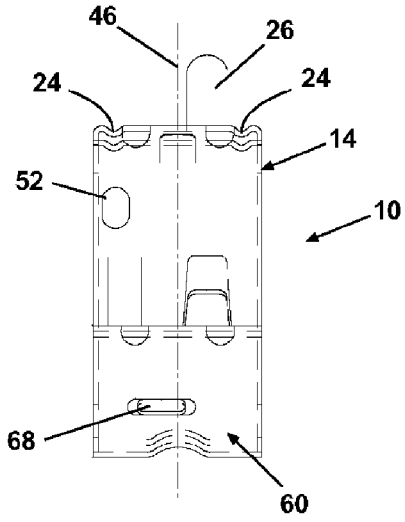
FIG. 4 is a front elevational view of the hanger bracket of FIG. 1.
Figure 5:
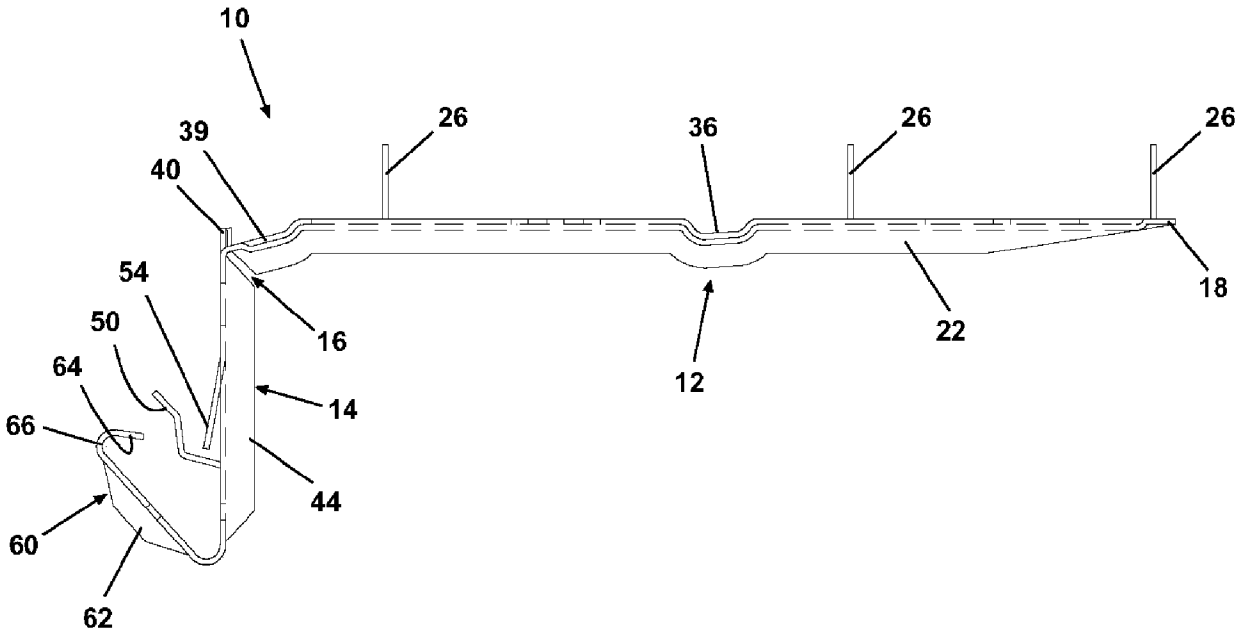
FIG. 5 is a side elevational view of the bracket of FIG. 1.
Figure 6:
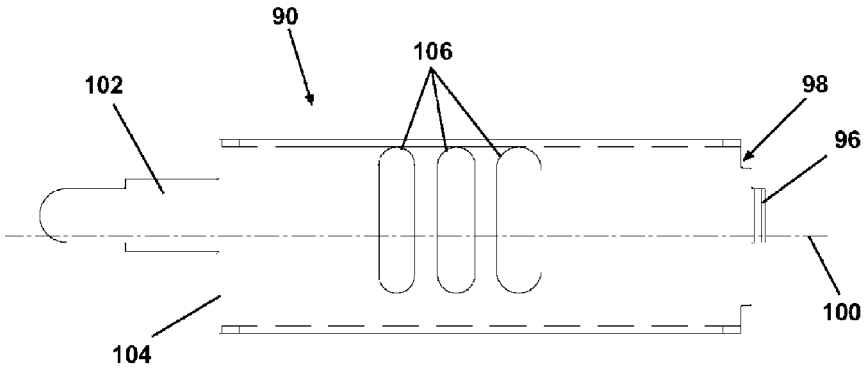
FIG. 6 is a top plan view of the brace of FIG. 2.
Figure 7:
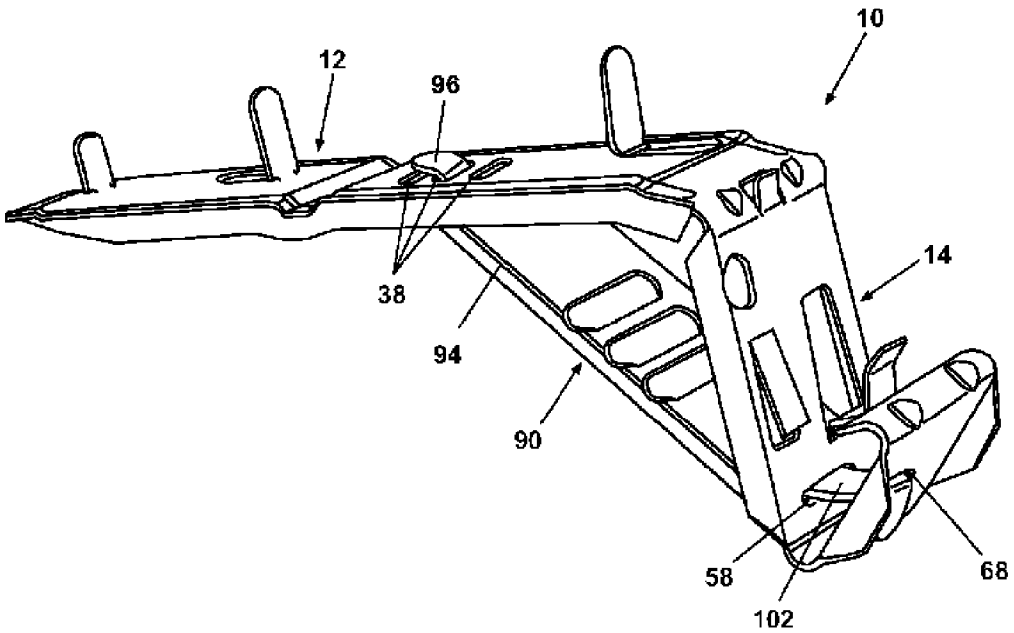
FIG. 7 is a perspective view of the hangar bracket of FIG. 1 assembled with the brace of FIG. 2.

Looking first at FIGS. 1-9, a first embodiment of a hanger bracket 10 according to the invention comprises a long arm 12 and a short arm 14, joined to each other at roughly a 90° angle at a junction 16. The long arm 12 has a distal end 18 that is designed to be located in proximity to or even to rest on an associated roof 20 (see FIGS. 8 and 9). Depending flanges 22 on the longitudinal sides of the long arm 12 provide strength and rigidity and tend to prevent the long arm from bending. Longitudinal ribs 24 or ridges can also be provided in the long arm 12 to assist in providing strength and rigidity.

A plurality of tabs 26 extends upwardly from the long arm 12 so that they are at substantially right angles to the upper surface 28 of the long arm. This facilitates insertion of the tabs through corresponding apertures 30 in a rainwater deflector 32 to be positioned atop the hanger bracket (see FIGS. 8 and 9). Following such insertion, the tabs 26 may be bent over with a wrench or other tool to hold the deflector 32 affixed to the bracket 10, as shown, for example, in FIG. 9. In accord with the invention, the tabs 26 are located off a centerline 34 of the long arm 12 (see FIG. 3).

A lateral channel 36 is disposed in the upper surface 28 of the long arm 12 approximately midway between the distal end 18 and the junction 16. Also, a plurality of lateral slots 38 is located in the long arm 12 on a side of the centerline 34 opposite the tabs 26. A second lateral channel 39 is disposed at the junction 16 of the long arm 12 with the short arm 14. A support tab 40 extends upwardly at the junction 16 adjacent the second lateral channel 38. Small radiuses 42 and on either side of the support tab 40 provide additional strength at the junction 16.

As with the long arm 12, depending flanges 44 on the longitudinal sides of the short arm 14 provide strength and rigidity and tend to prevent the short arm from bending. The short arm 14 has a centerline 46 that is coplanar with the centerline 34 of the long arm 12. Beneath the junction 16 on one side of the centerline 46, and generally in the same plane as the tabs 26, a trapping tab 50 extends outwardly and upwardly. A mounting hole 52 is disposed in the short arm 14 opposite the centerline 46 from the trapping tab 50, and immediately adjacent the depending flange 44 at the edge of the short arm.

An outwardly and downwardly extending gripping tab 54 is located beneath the mounting hole 50, opposite the centerline 46 from the trapping tab 50. Between the trapping tab 50 and gripping tab 54 on one side, and the distal end 56 of the short arm 14 on the other side, is a lateral slot 58 mostly on the same side of the centerline 46 as the lateral slots 38 on the long arm 12.

Extending upwardly and outwardly from the distal end 56 of the short arm 14 is a gutter support flange 60, having depending flanges 62 on its longitudinal edges for strength, and an inturned ledge 64 at its terminal end 66. A lateral slot 68 is located in the gutter support flange 60 opposite the lateral slot 58 on the short arm 14.

Preferably, the hanger bracket 10 is made of a lightweight, strong, rust-free material such as aluminum or copper. It can be formed in one or more stamping operations by a die. Looking now more closely at FIGS. 8 and 9, in use, the inturned ledge 64 captures a commonly formed outer edge 70 or lip of a conventional rain gutter 72. The distal end 18 of the long arm 12 rests on the roof 20 and is preferably secured to the roof by fasteners, such as screws. It will be understood that in normal use a plurality of hanger brackets 10 will be disposed along a roof line at spaced intervals, typically one bracket every 2.5 to 5 linear feet of gutter. Heater cables 74 can be laid in the lateral channels 36, 39 of the long arms 12 where they are less prone to move or slide or fall off the bracket 10. A rainwater deflector 32 is positioned atop the hanger bracket 10 and secured to the long arm 12 by the aforementioned tabs 26. An arcuate nose 76 of the rainwater deflector 32 is formed when the terminal edge 78 of the rainwater deflector is trapped by the trapping tab 50. The rainwater deflector 32 is thus securely attached to the hanger bracket 10 in proper position to permit rainwater runoff from the roof 20 to follow the arcuate nose 76 into the gutter 72 by surface tension while its positioning enables debris from the roof 20 to fall off the rain water deflector without entering the gutter.

Looking now at FIGS. 6-9, an optional brace 90 can be mounted between the long arm 12 and the short arm 14 to provide additional strength and support for the hanger bracket 10 as well as for mounting the hanger bracket directly to the fascia 92. The brace 90 can be formed from a flat piece of stock similar in material to the hanger bracket 10, and comprises depending flanges 94 from its longitudinal edges for rigidity and strength. A mounting tab 96 extends from an upper end 98, preferably at a 90° angle, offset from a centerline 100 of the brace. A longer tab 102 extends from a lower end 104, offset from the centerline 100 on the same side as the mounting tab 96. A plurality of lateral slots 106, slightly offset relative to the centerline 100, is located intermediate the upper 98 and lower 104 ends. When the brace 90 is to be mounted to the hanger bracket, the mounting tab is extended to any one of the lateral slots 38 in the long arm 12 and bent to secure it. The longer tab 102 is extended through the lateral slot 58 in the short arm 14 and the lateral slot 68 in the gutter support flange 60 and bent to secure.

Figure 8:
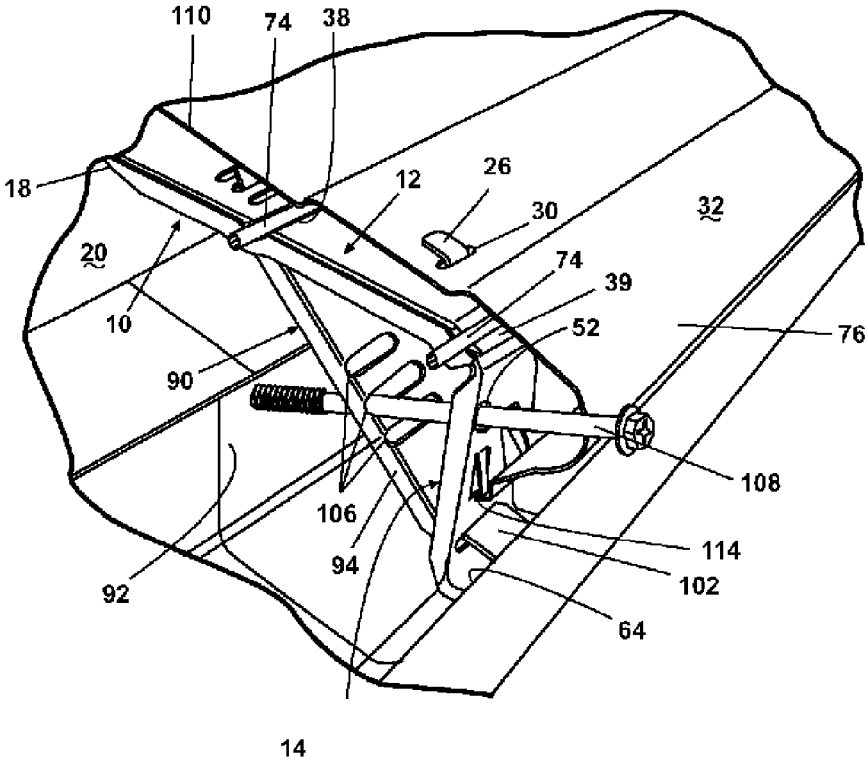
FIG. 8 is a perspective view showing the bracket and brace assembly of FIG. 7 in an installation.
Figure 9:
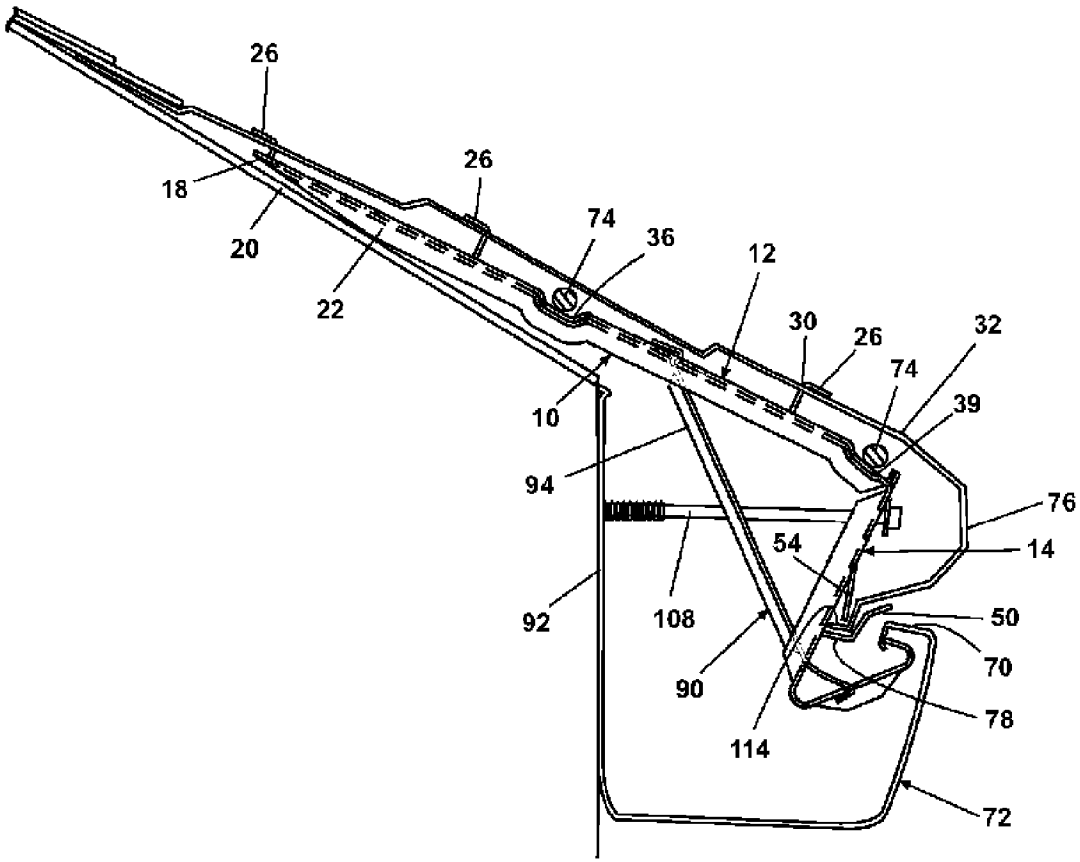
FIG. 9 is an end view, partly in cross section, of the installation of FIG. 8.
Figure 10:
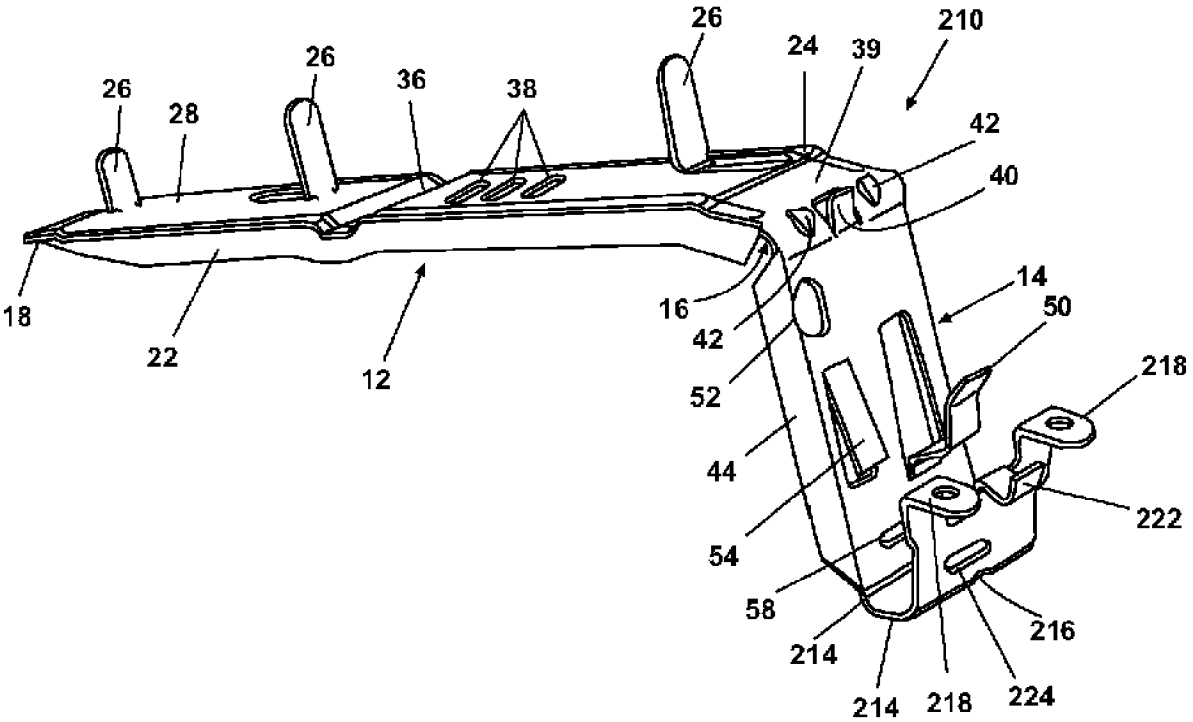
FIG. 10 is a perspective view of a second embodiment of a hanger bracket according to the invention.
Figure 11:
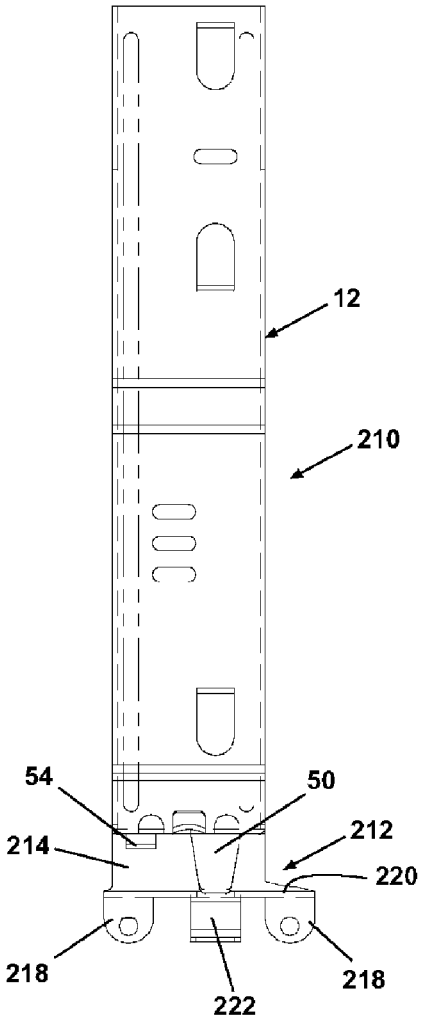
FIG. 11 is a top plan view of the hanger bracket of FIG. 10.
Figure 12:
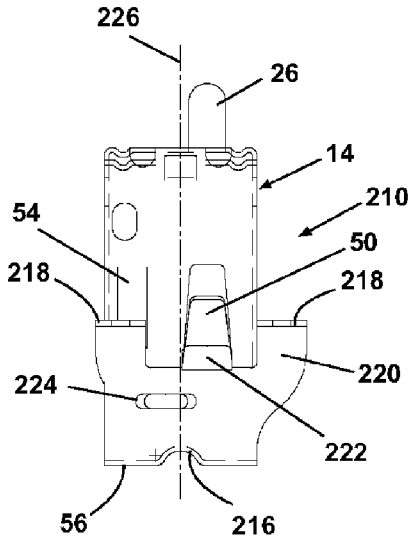
FIG. 12 is a front elevational view of the hanger bracket of FIG. 10.
Figure 13:
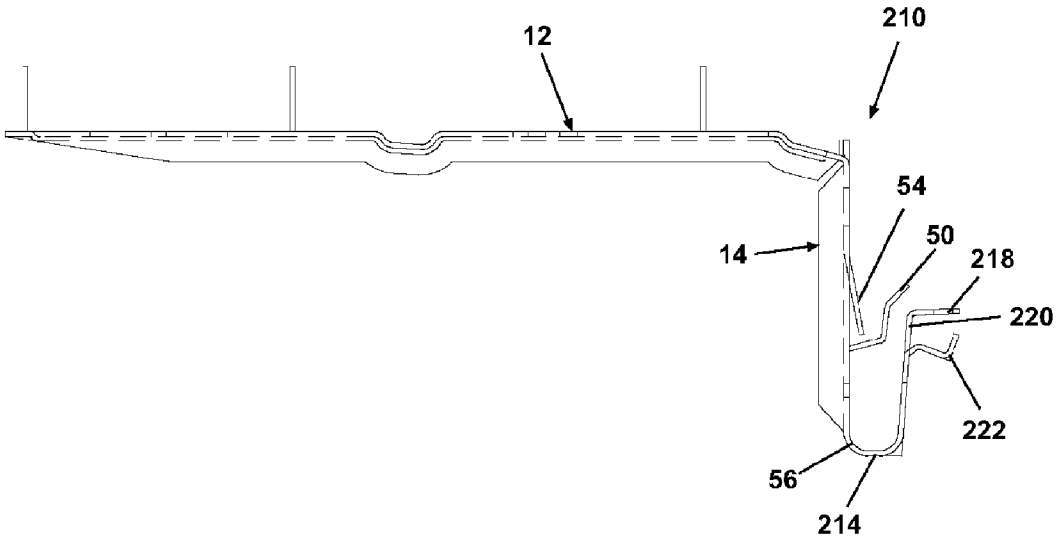
FIG. 13 is a side elevational view of the bracket of FIG. 10.
Figure 14:
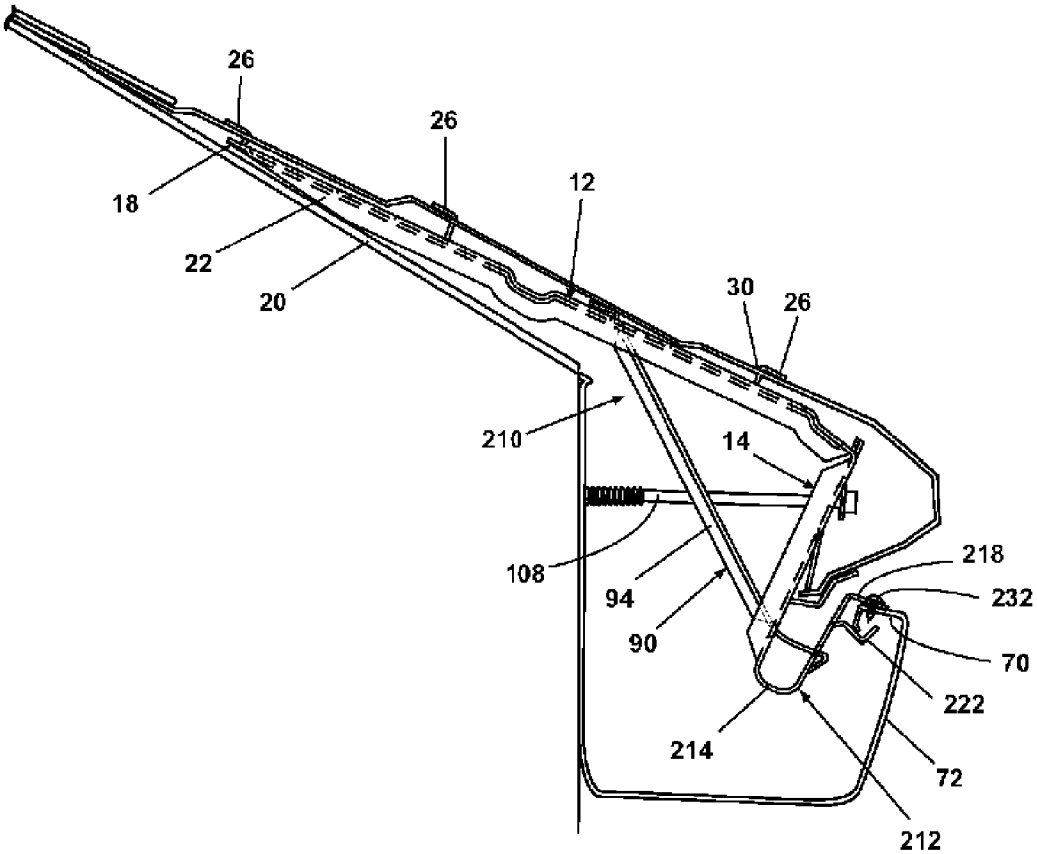
FIG. 14 is an end view, partly in cross section, of the hangar bracket of FIG. 10, assembled with the brace of FIG. 2, in an installation.

Looking again at FIGS. 8 and 9, with this structure, the hanger bracket 10 can be mounted directly to a fascia 92 by extending a fastener, such as a mounting bolt 108, through the mounting hole 52 in the short arm 14 and then through one of the lateral slots 106 in the brace 90 to the fascia. Advantageously, this structure enables an installer to position the bracket 10 and mount it to a fascia 92 by using an existing rainwater deflector panel 32. Here, one edge of a rainwater deflector panel will already be mounted to a hanger bracket, and the other edge will be free. Looking particularly at FIG. 8, a hanger bracket 10 in accordance with the invention assembled to the optional brace 90 can be positioned beneath a free edge 110 of the rainwater deflector panel 32 so that the tabs 26 on the long arm 12 extend through slots 30 in the rainwater deflector panel. The terminal edge 114 of the rainwater deflector panel 32 is trapped by the trapping tab 50. At the same time, the terminal edge 114 is also gripped by the gripping tab 54 so that the rainwater deflector panel 32 is held down against forces tending to lift it, such as wind. The distal end 18 of the long arm 12 is positioned on the roof 20, and the inturned ledge 64 on the gutter support flange 60 captures the outer edge 70 of the rain gutter 72. While in this position, the mounting bolt 108 can be extended through the mounting hole 52 in the short arm 14, and then through one of the lateral slots 106 in the brace 90 to the fascia 92.

A second embodiment of a hanger bracket 210 according to the invention can be seen in FIGS. 10-14. The hanger bracket 210 is identical in all salient respects to the first embodiment, but for the manner in which it connects to a gutter. Thus, like components will bear like numerals to those in the first embodiment 10. The hanger bracket 210 is designed to be a universal bracket, capable of attaching to nearly any type of gutter commonly used in the U.S. Looking now more particularly at FIGS. 10-13, it is seen that the hanger bracket 210 has a gutter support flange 212 that extends from the distal end 56 of the short arm 14 within a few degrees of the plane of the short arm. The gutter support flange 212 is spaced from the short arm 14 by a channel 214 to allow enough room for the gripping 54 and trapping 50 tabs. A lateral radius 216 in the bight portion of the channel 214 strengthens the channel against bending. Two screw tabs 218 extend roughly normally from the terminal end 220 of the gutter support flange 212. A trap tab 222 extends outwardly in the same direction as, and spaced beneath the screw tabs 218. A lateral slot 224 is offset from a centerline 226 of the gutter support flange 212.

The hanger bracket 210 can optionally be assembled to the brace 90 in the same manner as the hanger bracket 10, with the long tab extending through the lateral slot 224. The manner of attachment of the hanger bracket 210 to a rain gutter 72 is illustrated best in FIG. 14. The trap tab 222 is placed beneath the terminal edge flange 70 of the gutter 72. The screw tabs are positioned over the terminal edge flange 230, where sheet metal screws 232 can secure the gutter support flange 212 to the gutter 72.

As described above, some aspects of the present invention provide a hanger bracket for a rainwater deflector in a gutter system. The hanger bracket comprises channels for holding heater cables, flanges and ribs to strengthen the bracket against bending, and a ledge that captures and holds the lip of a gutter without fasteners. Tabs on one side of the bracket engage a panel of the rainwater deflector, while a mounting hole on the other side of the bracket enables the bracket to be mounted to the fascia after the panel is affixed.

Gutter Protection System

Aspects of the present invention further provide a gutter protection system, device and method. The gutter protection system and device of the aspects of the present invention include a screen, filter, or filter screen that covers a panel portion of the gutter protection system to yield a screened gutter protection system and device. The gutter protection method of the aspects of the present invention provides a method of making and a method of installing the screened gutter protection system and device of the aspects of the present invention.

The screened gutter protection device, method and system of the aspects of the present invention provide several benefits. They keep leaves, pine needles, seeds and stone granules out of the gutter. They eliminate or reduce clogging in the gutter systems and the associated cleaning processes that tend to be dangerous. Some aspects use a novel louvered technology adapted for siphoning rain. Some aspects use vertical louvered openings arranged in rows that are offset with respect to one another to enhance drainage. Some aspects may be presented in different colors including white, brown, bronze and charcoal. Some aspects may be installed beneath the first row of shingles using substantially invisible or barely visible installation. Some aspects fit on most existing gutter systems. Some aspects include molded filter screen that channels the rain flow into the gutter through the vertical openings in the louvers. Some aspects include a panel that has alignment ribs for alternate 5K and 6K fascia mounting. Some aspects may be used for screen rooms or pool cage super gutters. Some aspects may be installed on any type of roofing including slate, steel or tile. Some aspects may be installed at a slight angle to help debris roll off by wind or rain. Some aspects include a screen, filter, or filter screen that is made from stainless steel micro mesh that filters rain water from debris. Some aspects are capable of handling significant volumes of water.

In general, gutter protection system installations begin with an inspection of the gutters to confirm the amount of material required, and also to determine the best method of installation. When a protection system is to be installed for gutter protection, prior to the installation, the gutters are cleaned and tested to ensure that they are free of clogs and in proper working order. Installation of gutter protection devices and systems and other procedures are carried out after it is determined that the gutter is ready for the gutter protection system.

Figure 15A:
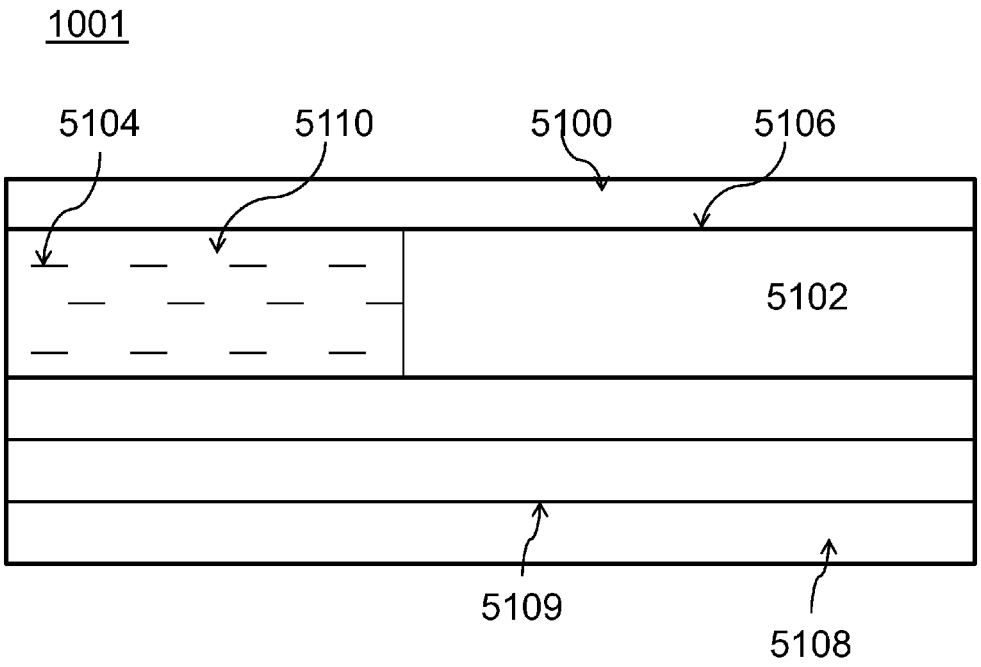
FIG. 15A shows a plan view of the gutter protection system, according to the aspects of the present invention.
Figure 15B:
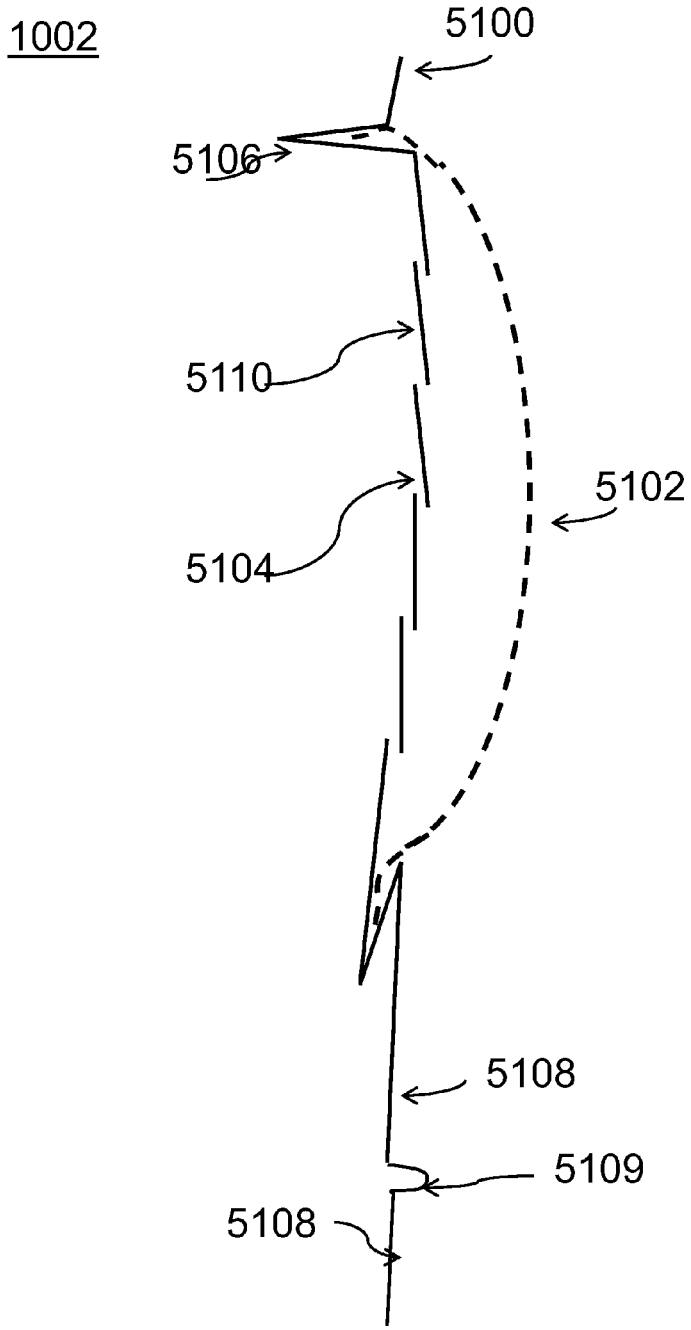
FIG. 15B shows a side view of the gutter protection system, according to the aspects of the present invention.

FIG. 15A and FIG. 15B show a plan view and a side view of the gutter protection system, according to the aspects of the present invention.

View 1001 in FIG. 15A shows a plan view of the gutter protection system, according to one aspect of the present invention. The gutter protection system includes a panel that is partially covered by a screen, filter or filter screen 5102. The panel is continuous and begins with an outer edge or outer portion 5100 leading to a locking bead 5106, a louvered portion 5110 and a ribbed extension 5108. The screen 5102 covers the louvered portion 5110 of the panel and is secured to the panel on two sides of the louvered portion 5110 along the outer portion 5100 and along the extension 5108.

The louvered portion of the panel 5110 includes the louvered rows 5104. The screen 5102 covers the louvers. The extension 5108 includes alignment ribs 5109 and lies on the roof while the outer portion 5110 is secured to the outer edge or lip of the gutter away from the roof.

View 1002 in FIG. 15B shows the same elements from a side view. The locking bead 5106 is formed such that any weep holes that are formed by the locking bead are unobstructed.

Some aspects of the system of the present invention may be used for commercial buildings and other applications where the use of brackets and reverse curve technology impedes installation.

In some aspects of the present invention, a convex screen design readily sheds the debris. This convex design can be observed from the profile of the screen 5102 in FIG. 15B. In one aspect of the present invention, the screen, filter, or filter screen may be implemented using a stainless steel micro mesh and the louvers may be implemented using a vortex louver system. Either of these two implementations, as well as the combination of the two, draws rainwater into the gutter while substantially preventing the debris from entering. The system is substantially impermeable to even small particles, such as shingle, grit and pollen.

In one aspect of the present invention, the screen, filter or filter screen may be constructed from heavy gauge 0.024 aluminum material to maximize strength and is coated with an industrial Kynar® paint system to preserve the finish. Kynar® is a registered trademark of ARKEMA Inc., 2000 Market Street, Philadelphia, Pa. 19103, USA.

In one aspect of the present invention, the screen, filter or filter screen may be constructed of Micro-CS™ which is a trademark of Gutter Helmet® which is in turn a registered trademark of the Southeastern Metals Mfg. Co., 11801 Industry Drive, Jacksonville, Fla. 32218, USA.

While, in one aspect of the present invention, the panel may be formed from one continuous sheet of material and connected to the screen through locking beads, in other aspects, the various parts of the panel may be formed from separate material and later connected together. For example, the louvered portion may be formed separately and connected to the screen and the combination of the louvered portion and the screen may be later connected to the ribbed extension portion.

In some aspects of the present invention, the screen may be connected to the louvered portion through means other than the locking beads.

The louvered technology including the substantially vertical openings, the molding of the screen to the louvered portion, the hemmed and rolled locking bead connection of the screen to the louvered portion, the domed shape of the louvered portion, the convex nature of the screen that is fitted over the domed section, and the offset character of the rows of louvers, may be utilized alone or in combination to form a screened gutter protection system according to various aspects of the present invention.

In some aspects of the present invention, the panel may be installed over the roof such that it forms a slight angle with the horizontal. The angle facilitates rolling off of debris away from the roof by wind or rain water.

Figure 15C:
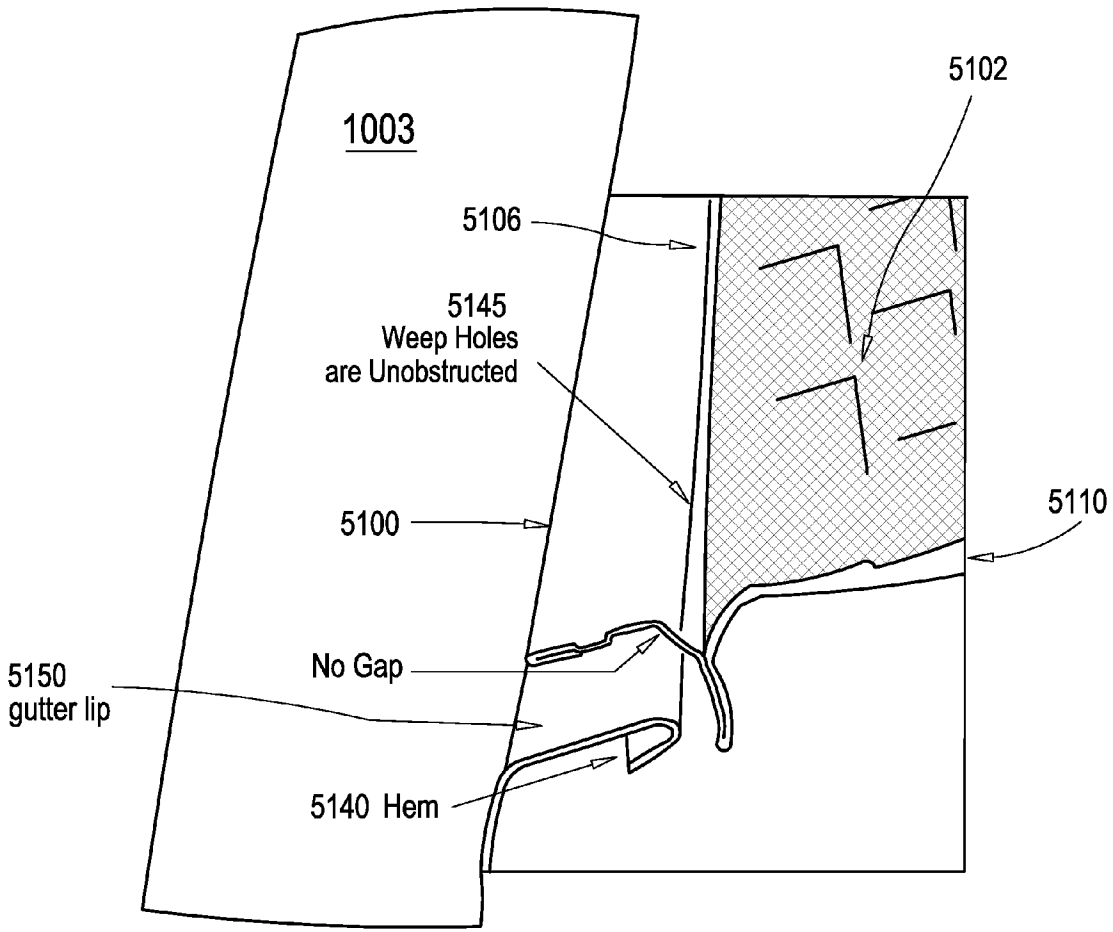
FIG. 15C shows a photograph of installation of a panel of a gutter protection system over the gutter, according to the aspects of the present invention.

FIG. 15C shows a photograph of installation of a panel of a gutter protection system over the gutter, according to the aspects of the present invention.

The photograph 1003 shows a standard K-style gutter on which the gutter lip has a hem 5140. In the installation shown, the hem 5140 does not obstruct the weep holes 5145 from draining. To achieve this, the fastener screws should be tight enough to close the gap between the panel edge or outer portions 5100 and the gutter lip 5150. Properly installing and tightening the panel with fastener screws is intended to pull the lip 5150 of the gutter up to the panel edge or outer portion 5100, and not to bend the screen 5102 up or down to match the gutter lip 5150. Bending the screened panel may obstruct the weep holes 5145 from draining or may cause them to drain over the gutter lip beneath the panel.

Some other recommendations for installation of the screened gutter protection system of the aspects of the present invention include: use a dissimilar metal barrier when installing panels in contact with different metals; install screws at a 90 degree angle to the panels; try not to not install screws into the roof valley; try to close all gutter or panel end caps off completely; under-the-shingle installations may use screws only in the gutter nose; over-the-shingle installations use butyl sealant in addition to 3 roof screws; fascia mounts are suitable for metal and tile roofing, or screen room installations; it is recommended to maintain a level to positive panel pitch, with no reverse slope; and notching the panel vertical leg will allow tighter end butt connections. During manufacture and installation, natural oils may adhere to the product surface and cause minor runoff on newly installed systems. This may stop after approximately 30 days of exposure.

Some panels may be easily cut to fit using sheet metal snips. Field forming for fascia mount applications may be performed using a small sheet metal hand brake. Various alternate installation methods may be used to increase the rain flow volume control capacity at inside corner valley applications. In one method, an extra piece of filter covers the corner over the two filter portions forming the corner. In another method, the extra piece of filter does not cover the filtered part of the panel portions that form the corner. Splash guards may also be utilized.

Figure 16:
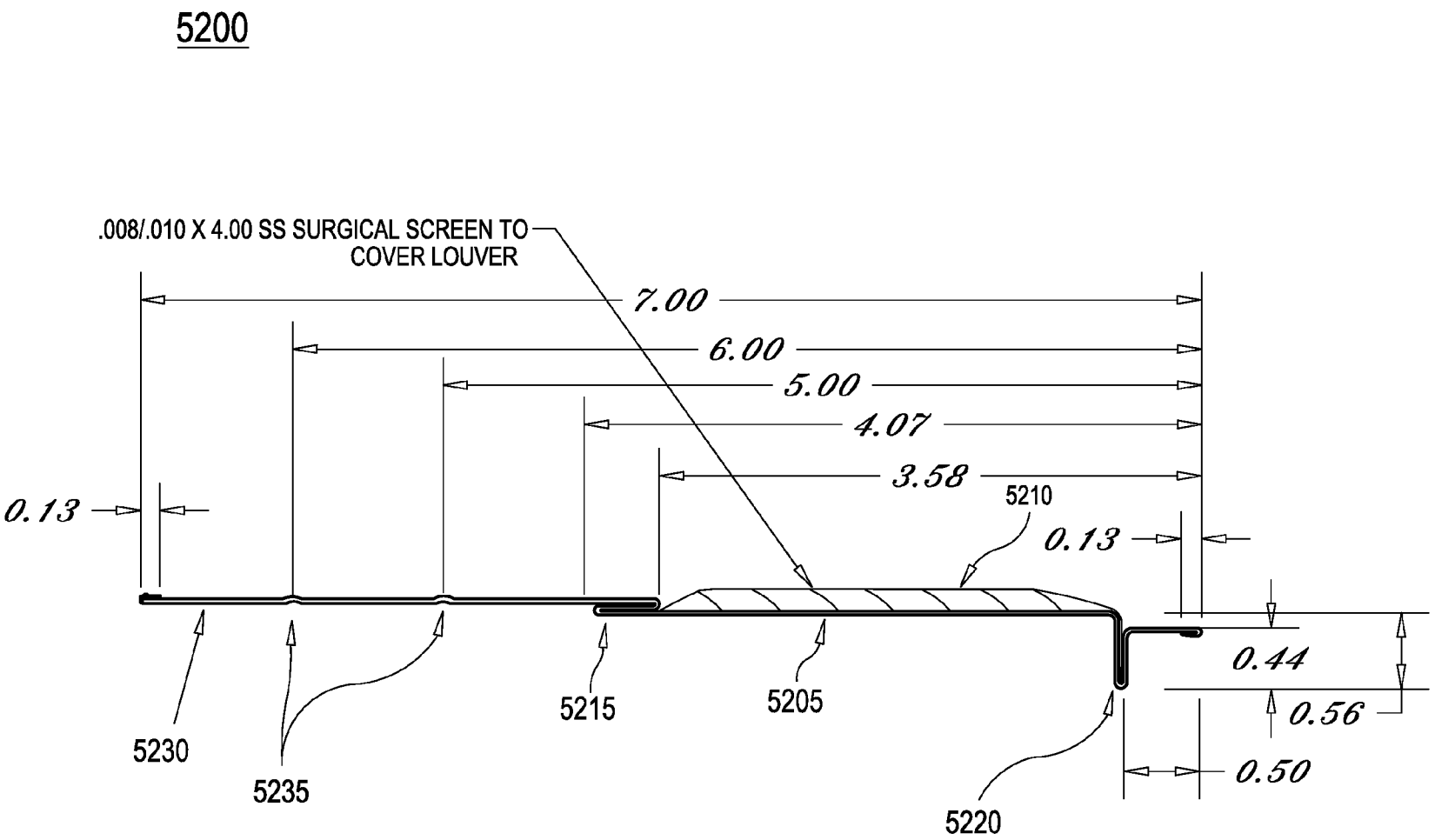
FIG. 16 shows a cross-sectional schematic drawing of an exemplary gutter protection system, according to the aspects of the present invention.

FIG. 16 shows a cross-sectional schematic drawing of an exemplary gutter protection system, according to the aspects of the present invention.

Some exemplary dimensions are marked on FIG. 16 and are in units of inches. FIG. 16 shows a screened gutter protection system 5200 according to the aspects of the present invention. The system 5200 includes a panel portion that is connected to a filter or screen. The panel portion includes louvered rows 5205. The louvered rows 5205 are covered by a molded screen 5210 and end in one rolled screen locking bead 5215 at one end and another rolled screen locking bead 5220 at the other end. The rolled screen locking bead 5215 is located at the side leading to the roof and continues in an extension 5230 that includes ribs 5235. The ribs 5235 are used to align the screened gutter protection system with the shingles on the roof and the extension 5230 is covered partially by the shingles or other roof material. The rolled screen locking bead 5220 helps secure the screened gutter protection system over the gutter.

Figure 17A:
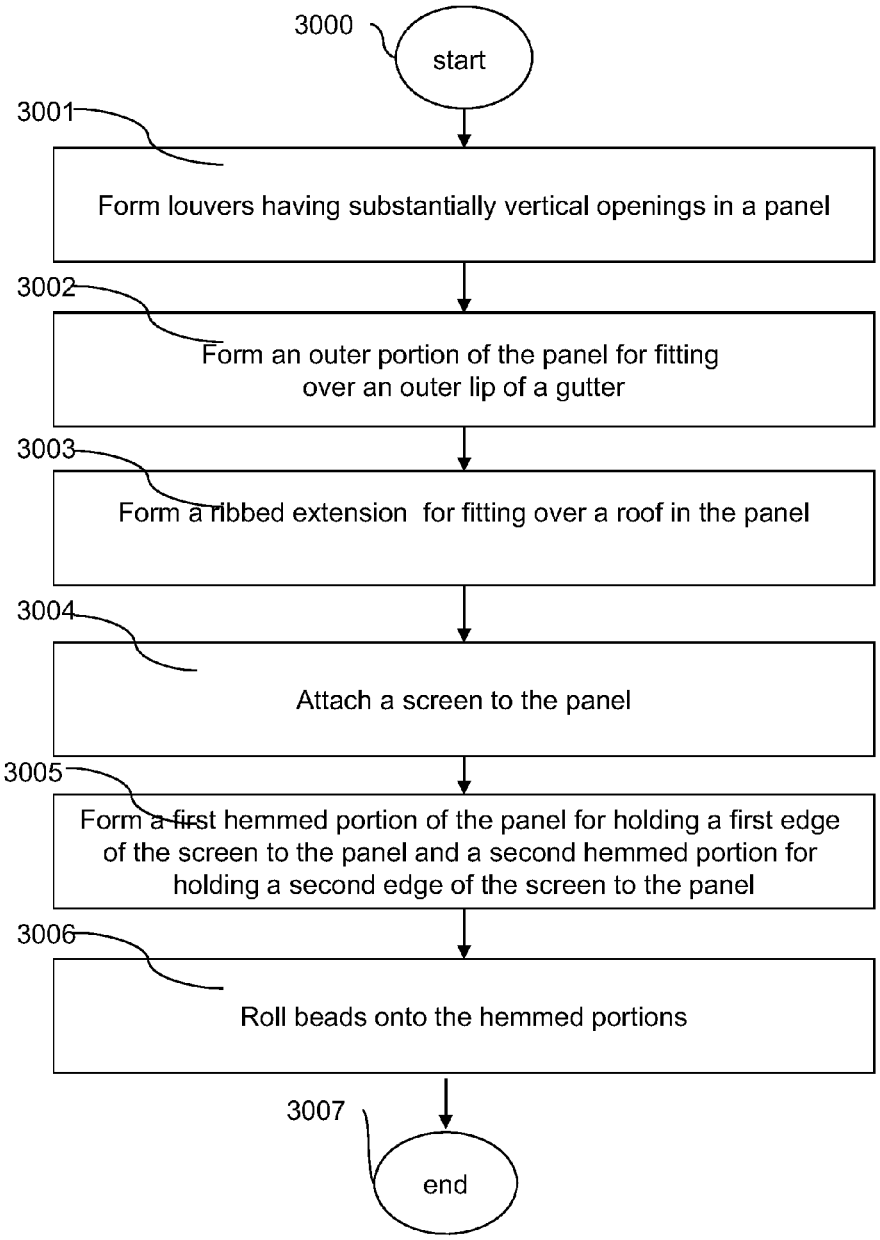
FIG. 17A shows a flowchart of a method of making a screened gutter protection system, according to the aspects of the present invention.

FIG. 17A shows a flowchart of a method of making a screened gutter protection system, according to the aspects of the present invention.

The method begins at 3000. At 3001, louvers having substantially vertical openings are formed in a panel. At 3002, an outer portion of the panel for fitting over an outer lip of a gutter is formed. At 3003, a ribbed extension is formed in the panel for fitting over a roof. At 3004, a screen is attached to the panel. At 3005, a first hemmed portion is formed in the panel for holding a first edge of the screen to the panel and a second hemmed portion is also formed for holding a second edge of the screen to the panel. At 3006, beads or ribs are rolled onto the hemmed portions to strengthen the connection between the screen and the panel. At 3007, the method ends. The above steps may be conducted in various orders. The panel may be formed having the louvers, the ribs and the hems and the screen may be attached to the formed panel at a later stage. Various portions of the panel may be formed from one continuous sheet of material or from separate parts and connected together after the screen is attached to the louvered portion of the panel. Other permutations are also possible.

Figure 17B:
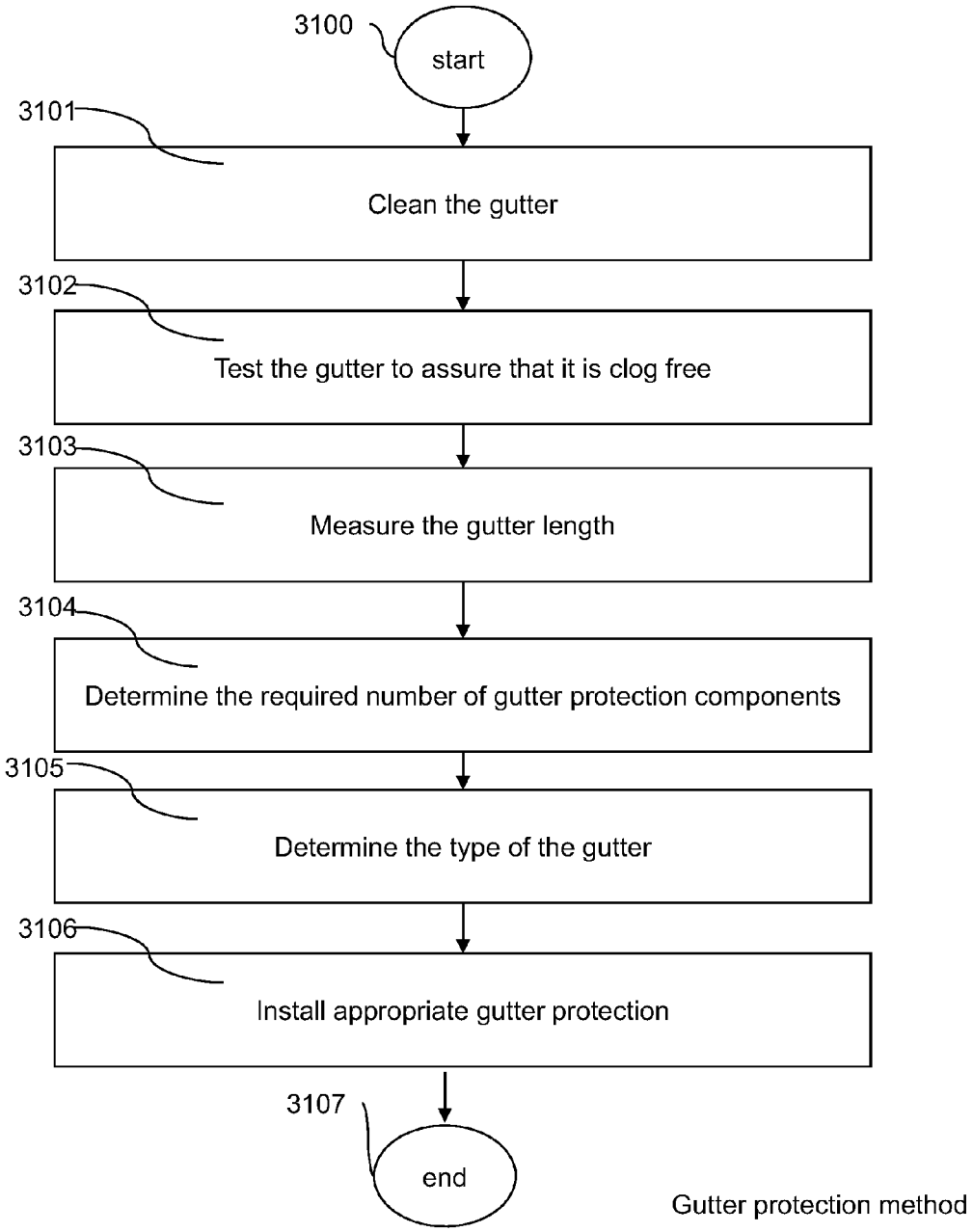
FIG. 17B shows a flowchart of a method of installing gutter protection, according to the aspects of the present invention.

FIG. 17B shows a flowchart of a method of installing gutter protection, according to the aspects of the present invention.

The method begins at 3100. At 3101, the gutter is cleaned. At 3102, the gutter is tested to assure that it is free of clogs. At 3103, the length of the gutter is measured. At 3104, it is determined how many gutter protection components are required to protect the gutter. For example, the gutter protection components may be 5'-0" long and may be trimmed with normal sheet metal cutting tools. Then, depending on the total length of the gutter, the required number of gutter protection components may be determined. At 3105, the size or type of the gutter is determined or confirmed. For example, the gutter opening is measured from the back of the gutter to the front tip. A 5" opening indicates a standard 5K and round gutter. A 6" opening indicates an oversized 6K gutter. Another type of gutter is a screen room or pool cage super gutter. At 3106, the appropriate gutter protection system is installed. At 3107, the method ends.

The gutter protection system of the aspects of present invention may be installed in several different manners. For example, the systems of the present invention provide ideal gutter protection for screen rooms or pool cages. The type of roof, the pitch, age and other factors may dictate the need for an alternative installation method. The appropriate method of installation for the type of gutter and roof that is at hand is determined by the installer and according to his judgment. When possible, the gutter protection system is installed with the back edge of the panel under the roofing material (see FIG. 18). This helps ensure better performance in most or all conditions.

Figure 18A:
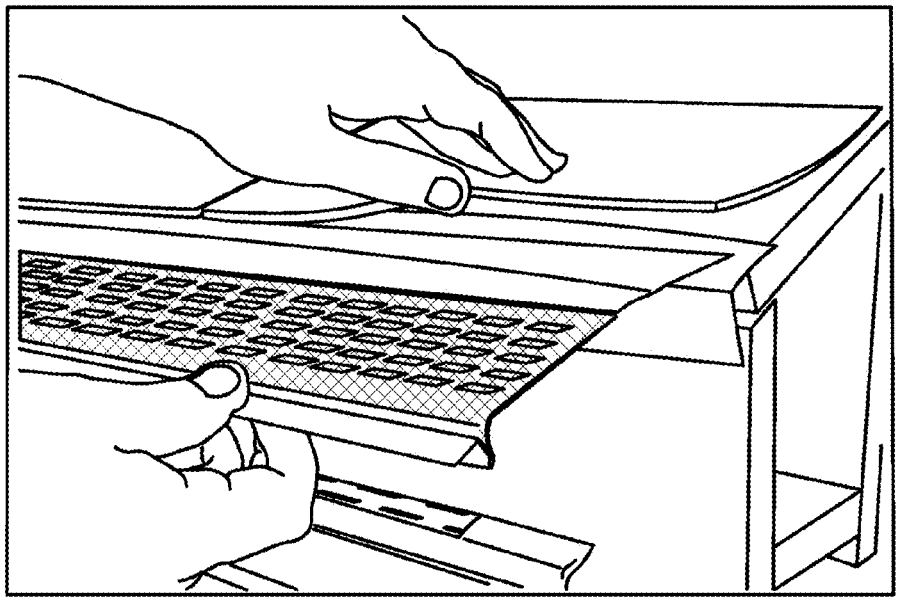
FIGS. 18A-18B show a photograph of a method of installing gutter protection, according to the aspects of the present invention.
Figure 18B:
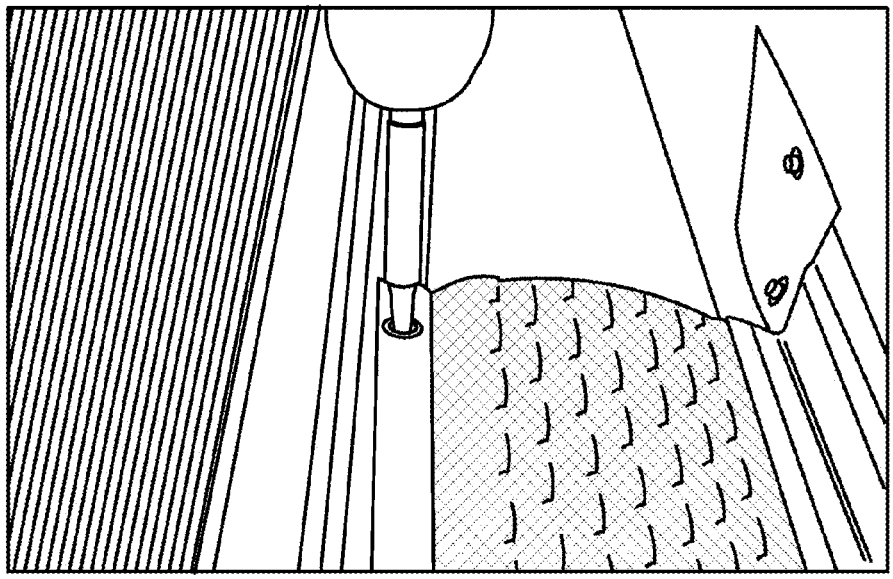
Figure 19:
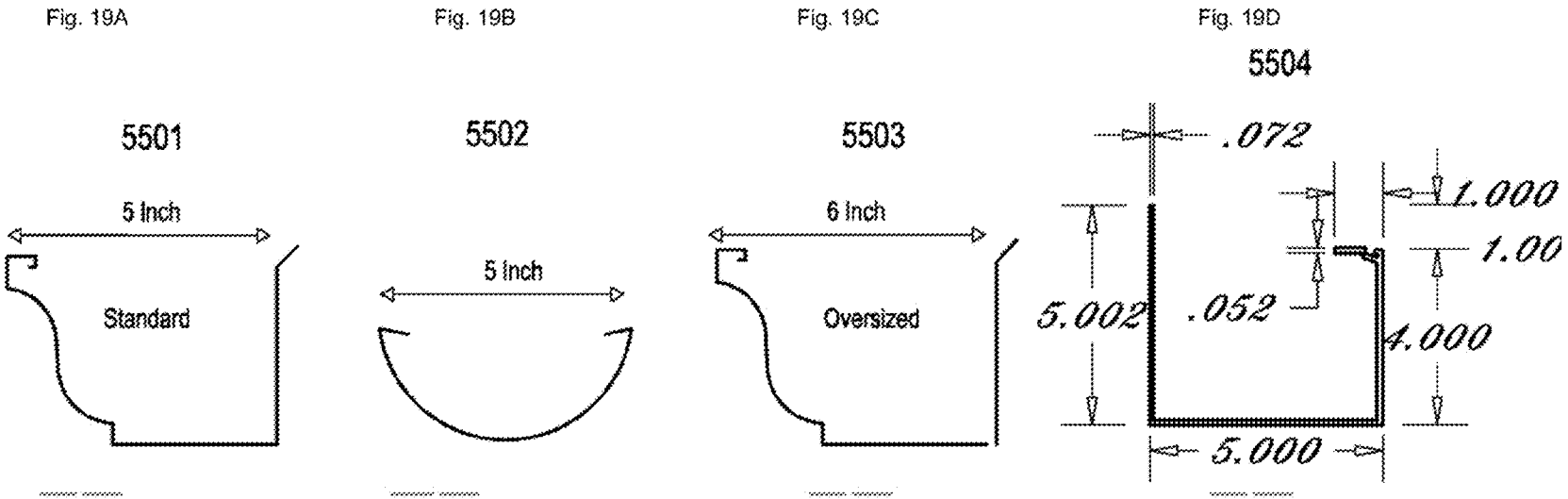
FIGS. 19A, 19B, 19C and 19D show the cross-sectional view of several types of gutters that may be covered by the gutter protection system according to the aspects of the present invention.

FIGS. 18A and 18B shows photographs of a method of installing a gutter protection system, according to the aspects of the present invention.

A typical rain gutter is made from aluminum. The customary method of installation of gutter protection for aluminum gutters is to slip the back edge of the gutter screen underneath the first shingle at the edge of the roof. Slipping the gutter screen under the shingle is shown at 4001 in FIG. 18A.

The gutter protection system, of the aspects of the present invention, incorporates alignment ribs to locate the screen for either 5-inch or 6-inch gutters. During the installation of the gutter screen, care is exercised not to damage the roofing material, namely the shingles, tile, shake, metal or other components. For example, for asphalt shingled roofs, and particularly for an old asphalt shingled roof, it is advisable to conduct the procedure on a warm day after the sun has warmed the shingles. This way, the aged shingles may be easier to work with. If asphalt shingles have a downward bend at the overhang, the shingles are lifted gently and slowly using a wide and flat tool such as a paint scraper. Once the gutter protection system is in place, the shingles will eventually settle and flatten without having been forced to do so. The front edge of the gutter screen is positioned over the lip of the gutter.

Once in place, the panel of the gutter protection system may be secured to the gutter lip. One exemplary method of securing the gutter protection system to the gutter lip is using ½" screws that are used approximately 1" from each end and throughout the middle. For example, six ½" Hex washer head piercing point screws may be used approximately 1" from each end of the panel and in the middle of the panel. The securing of the panel in place is shown at 4002 in FIG. 18B.

Specialty roofs such as shake, slate or metal often use fascia-mount installations. For fascia-mount installations, a break may be used to create a vertical 90° bend along the stiffener rib line for 5" or 6" gutters. The vertical bend along the back of the finished panel will rest flat against the fascia.

To install the screened gutter protection system around corners, one exemplary method includes butting one panel of the system in the 90° corner and another panel of the system into the side of the screened panel and securing the two panels together with two ½" screws. When corners and gutter ends need to be sealed, the ends are field fabricated using gutter flashing material. For example, a 1.5" angle may be used to block the openings secured to the panel or to the gutter by either two ⅛" by 3/16" pop rivets or two ½" screws.

FIGS. 19A, 19B, 19C and 19D show the cross-sectional view of several types of gutters that may be covered by the gutter protection system according to the aspects of the present invention.

FIGS. 19A, 19B, 19C and 19D shows the cross-sectional view of a 5" standard gutter 5501, a 5" round gutter 5502, a 6" oversized gutter 5503 and a screen room or pool cage supper gutter 5504. The gutters shown in FIGS. 19A, 19B, 19C and 19D provide examples of gutters for which the gutter protection system of the aspects of the present invention may be employed.

Figure 20:
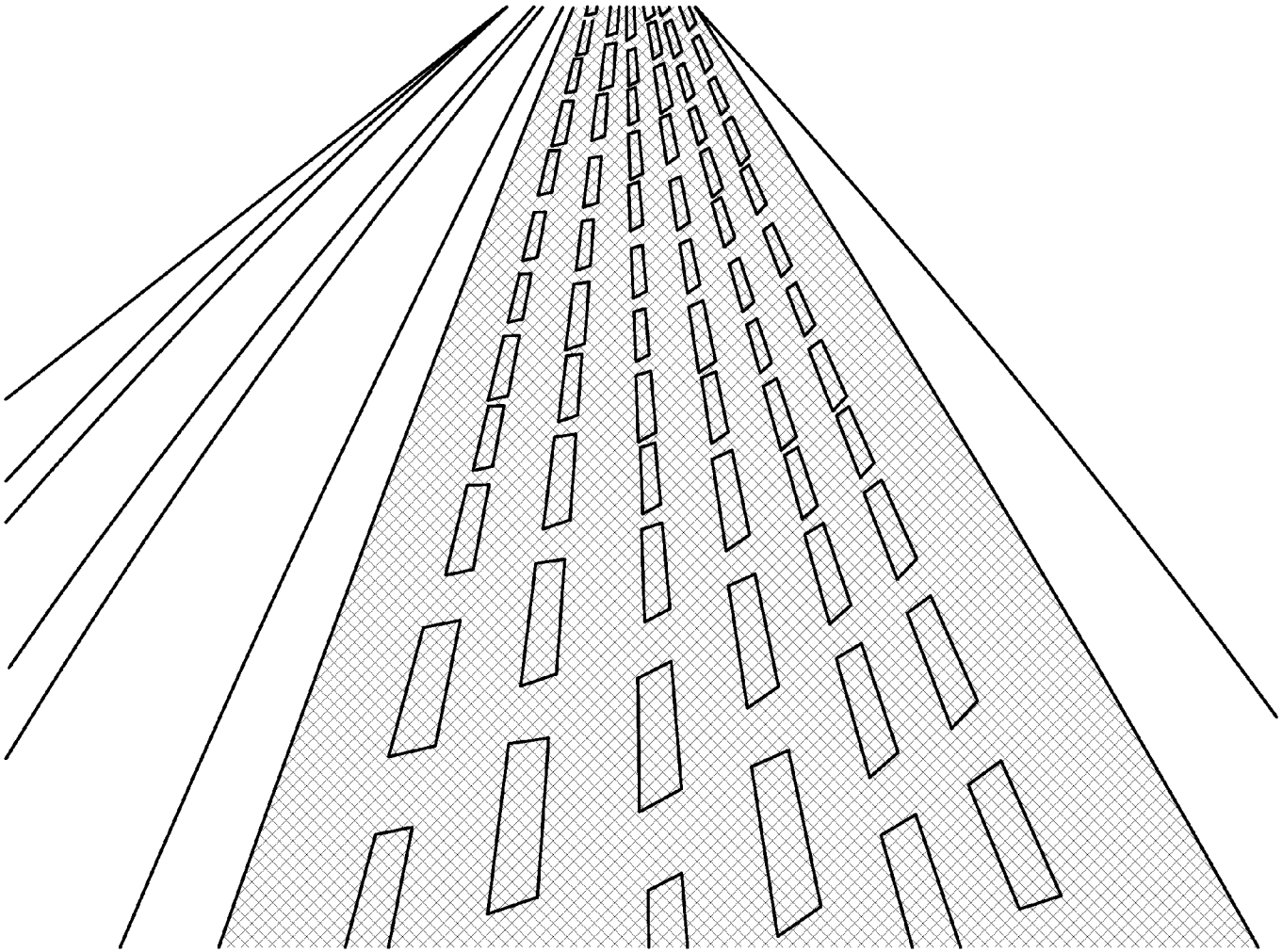
FIG. 20 shows a photograph of a molded filter screen design for a gutter protection system, according to the aspects of the present invention.

FIG. 20 shows a photograph of a molded filter screen design for a gutter protection system, according to the aspects of the present invention.

In one aspect of the present invention, the filter screen is molded to channel the rain flow to the gutter drain through the vertical openings in the louvers. The vertical openings of the louvers create a siphoning effect and molding the screen, filter or filter screen to the louvers maintains the effect created by the louvers.

Figure 21:
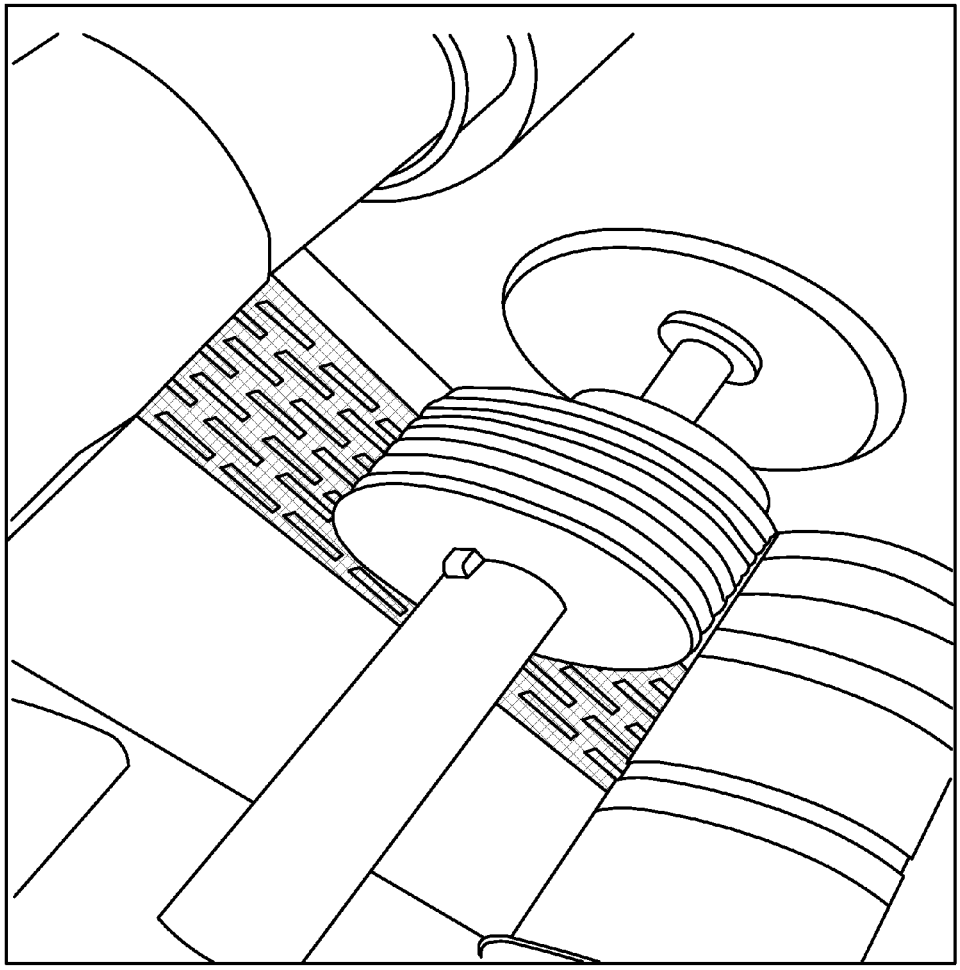
FIG. 21 shows a photograph of one method of molding the molded filter screen design, according to the aspects of the present invention.

FIG. 21 shows a photograph of one method of molding the molded filter screen design, according to the aspects of the present invention.

As shown in FIG. 20 and FIG. 21, the screen is molded to the louver rows by using a roller over the screen. The molding creates channels along the louver rows that lead the rain flow to the louvers and the openings below them. The rain water is led into the gutter from the louver rows.

FIG. 22, FIG. 23, FIG. 24 and FIG. 25 present photographs showing various views of the screened gutter protection system of the aspects of the present invention.

Figure 22:
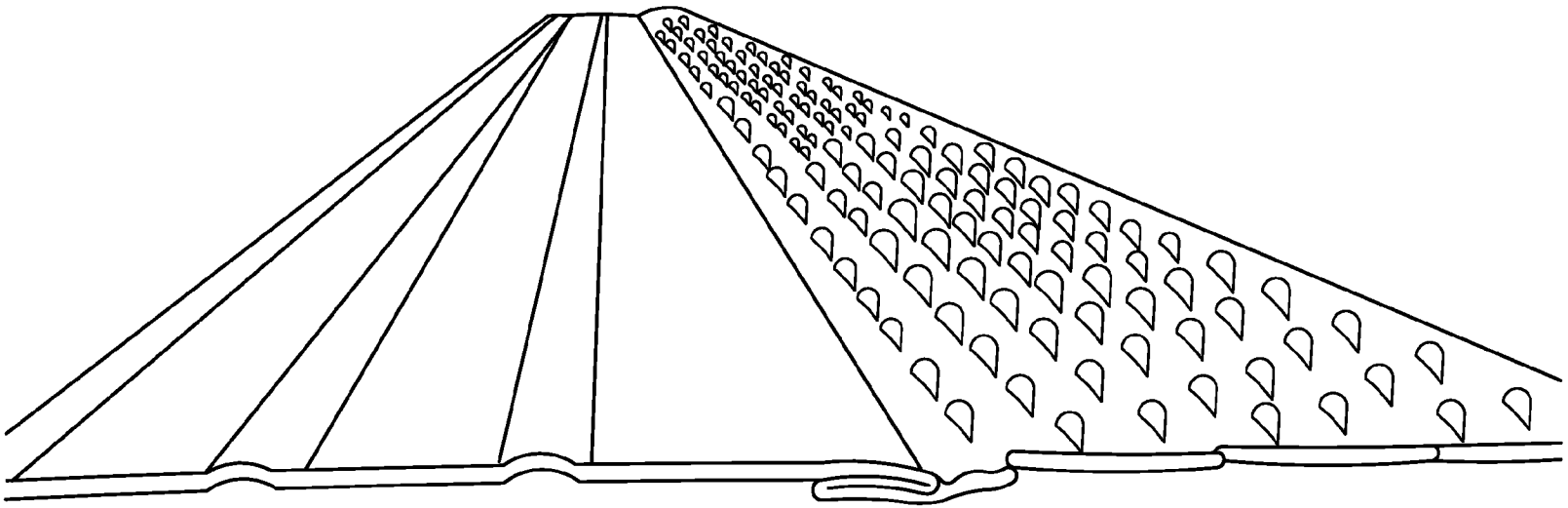
FIG. 22 shows a photograph of the louvered rows and the gutter below, according to the aspects of the present invention.

FIG. 22 shows a photograph of the louvered rows and the gutter below, according to the aspects of the present invention.

As shown in FIG. 22, the louvers stand substantially vertically to a plane of the panel to form openings that are substantially vertical to the plane of the panel. This photograph provides a view of the ribs formed in the extension portion of the panel and the rolled locking beads. In this photograph, the screen has not been attached to the panel and a clear view of the louvered rows is provided.

Figure 23:
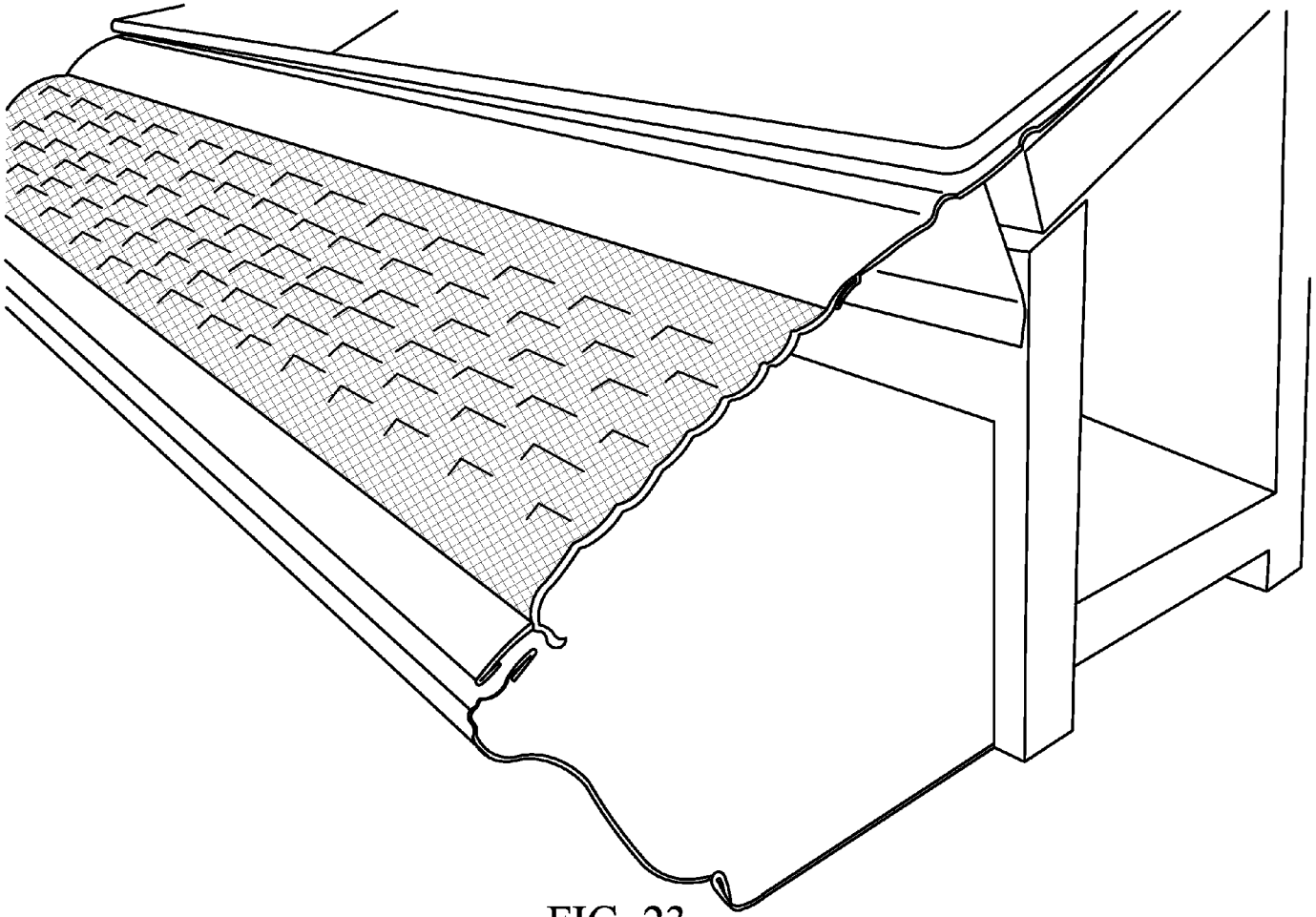
FIG. 23 shows a photograph displaying the installation of the panel of the screened gutter protection system beneath the shingle and above the gutter, according to the aspects of the present invention.

FIG. 23 shows a photograph displaying the installation of the panel of the screened gutter protection system beneath the shingle and above the gutter, according to the aspects of the present invention.

A perspective view of the cross-section of the gutter is apparent in the photograph of FIG. 23. In this photograph the screen is covering the louvers and is molded over them. Therefore, a clear view of the louvers is not provided. However, the photograph of FIG. 23 shows the extension of the panel being fitted under the roof material and the ribs being used for aligning the screened panel under the roof material.

Figure 24:
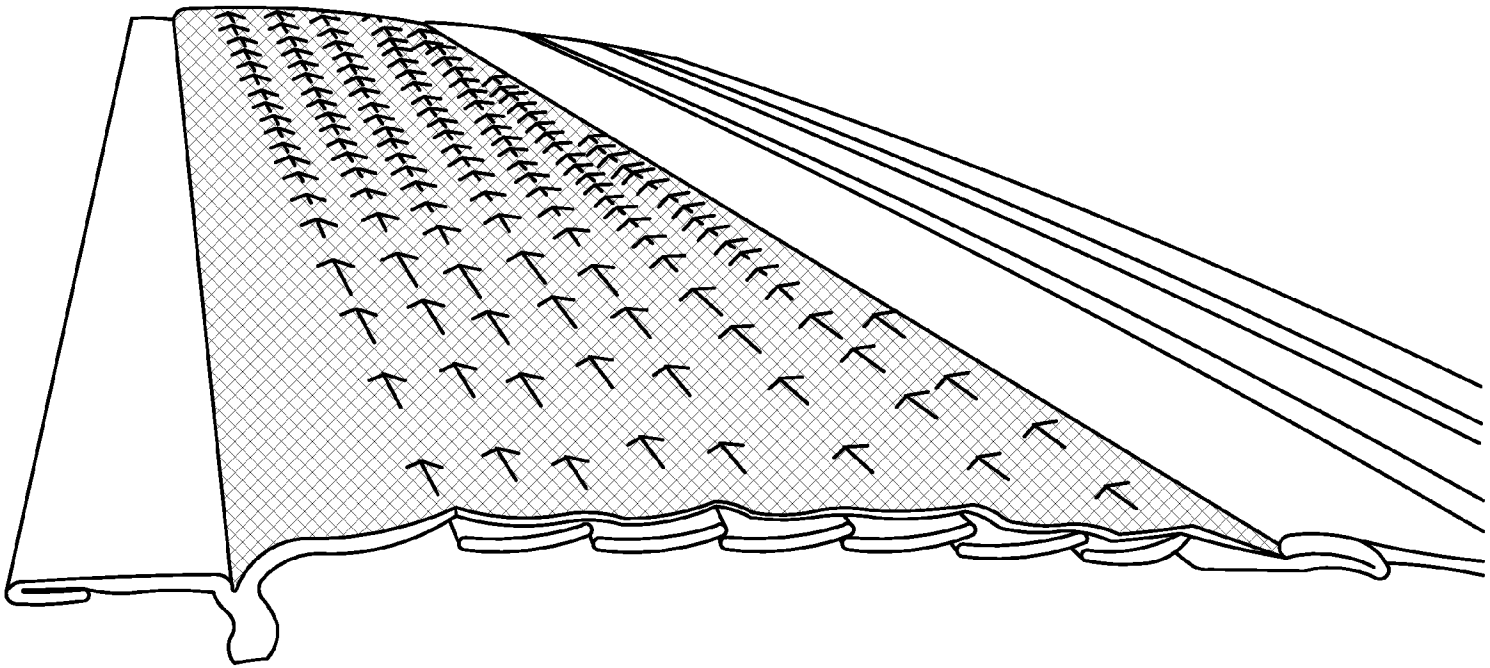
FIG. 24 shows a photograph of an end view of a gutter protection system showing a profile of the filter screen and the panel, according to the aspects of the present invention.

FIG. 24 shows a photograph of an end view of a screened gutter protection system showing a profile of the screen and the panel, according to the aspects of the present invention.

In the photograph of FIG. 24 an end edge of the screened panel is shown. The photograph shows how the screen is secured to the panel by being placed in the hems on the two sides of the louvered portion of the panel and a subsequent rolling of ribs or beads onto the hemmed portions.

Figure 25:
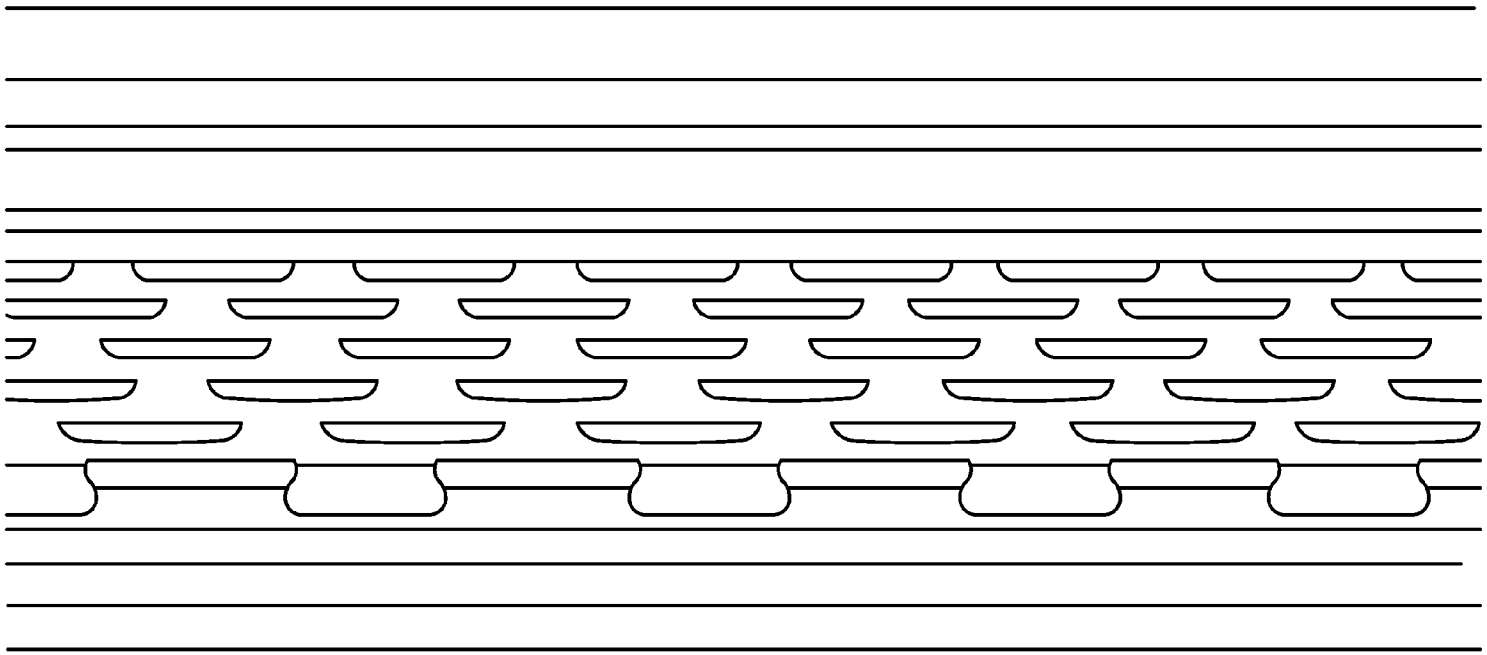
FIG. 25 shows a photograph taken from beneath the panel of the gutter protection system, according to the aspects of the present invention.

FIG. 25 shows a photograph taken from beneath the panel of the gutter protection system, according to the aspects of the present invention.

In the photograph of FIG. 25 the underside of the panel is shown. This side does not include the screen. However, the underside of the holes or openings corresponding to the louvers is apparent from the photograph. Further, this photograph shows the weep hole slots along the one of the hemmed portions of the panel near the edge of the panel.

Figure 26:
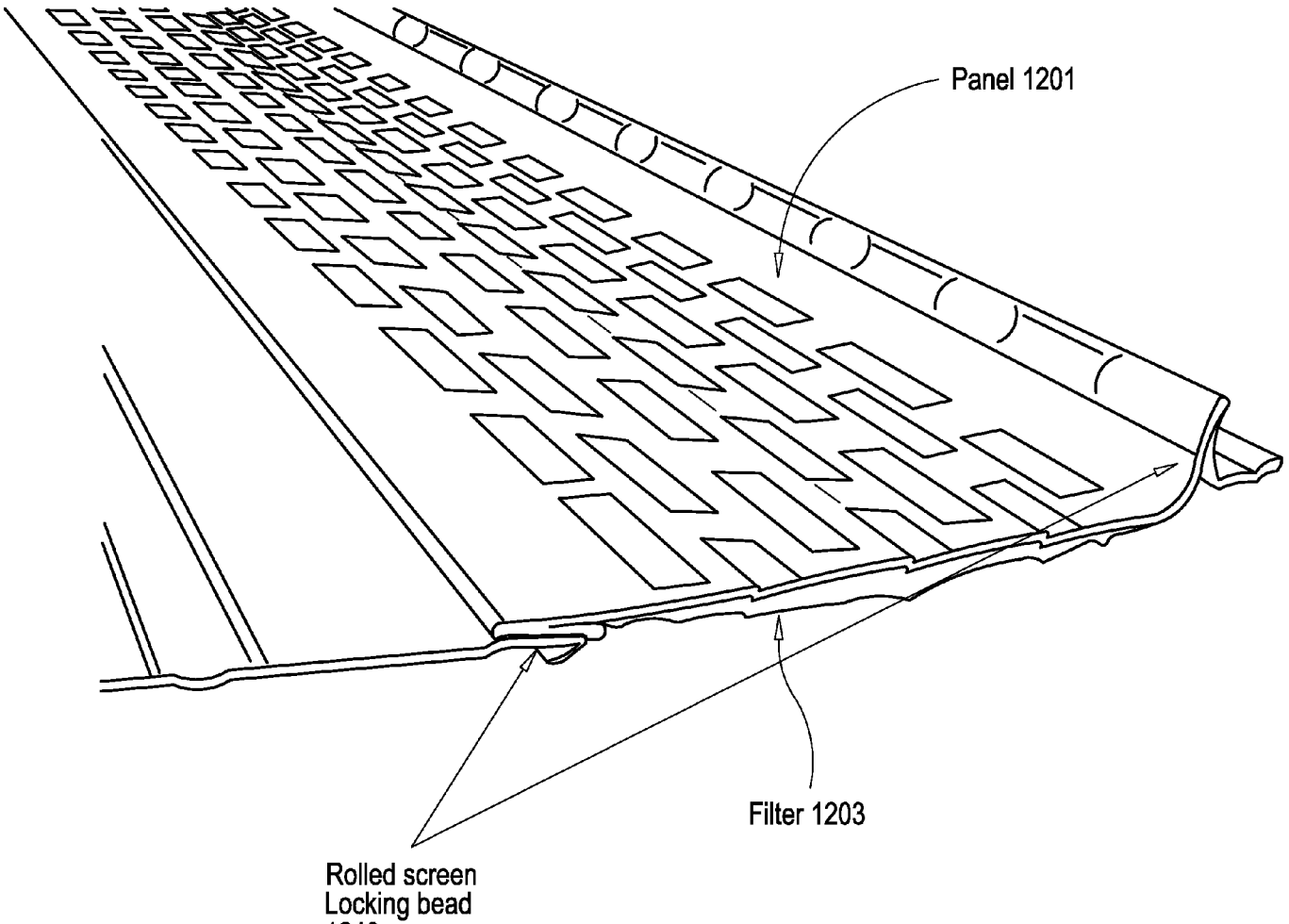
FIG. 26 shows a photograph of the gutter protection system showing rolled filter screen locking bead mechanisms, according to the aspects of the present invention.

FIG. 26 shows a photograph of the gutter protection system showing the rolled screen locking bead mechanisms, according to the aspects of the present invention FIG. 26 provides a photograph showing the screened gutter protection system from below. The system includes a panel 1201 and a screen or filter element 1203. A mechanism used for attaching the filter element 1203 to the panel 1201 is shown that includes the use of a rolled screen locking bead 1240 mechanism. This method of attachment does not require the use of glue. Rather, the method of the aspects of the present invention, utilizes hems with the filter element 1203 secured to two sides of the louvered portion of the panel 1201 by addition of a continuous rolled rib or bead 1240 on each side to lock in the screen 1203.

In one method according to the aspects of the present invention, the screen is laid in opposing hems on two sides of the louvered portion of the panel. Then beads or ribs are rolled onto the hemmed portion.

The rolled in continuous beads 1240 provide a novel mechanism for locking the screen or filter 1203 to the panel 1240. The rolled in continuous beads 1240 of the aspects of the present invention are distinguished from using glue or a mere hemming of the screen to the panel.

Figure 27:
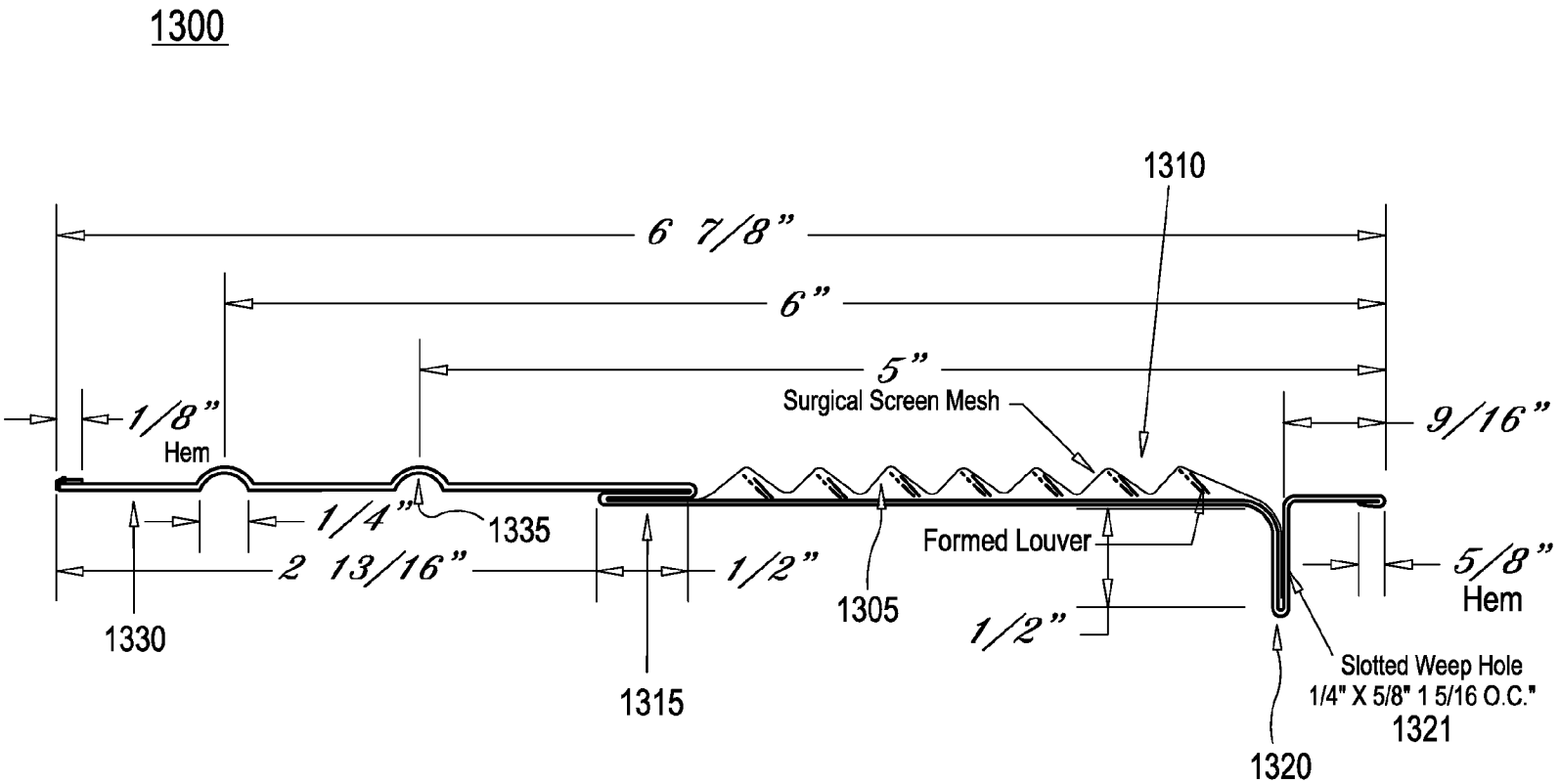
FIG. 27 shows a cross-sectional schematic drawing of another exemplary gutter protection system, according to the aspects of the present invention.

FIG. 27 shows a cross-sectional schematic drawing of another exemplary gutter protection system, according to the aspects of the present invention.

Some exemplary dimensions are marked on FIG. 27 and are in units of inches. FIG. 27 shows a screened gutter protection system 1300 according to other the aspects of the present invention. The system 1300 includes a panel portion that is connected to a filter or screen. The panel portion includes louvered rows 1305. The louvered rows 1305 are covered by a molded screen 1310 and end in one rolled screen locking bead 1315 at one end and another rolled screen locking bead 1320 at the other end. The rolled screen locking bead 1315 is located at the side leading to the roof and continues in an extension 1330 that includes ribs 1335. The ribs 1335 are used to align the screened gutter protection system with the shingles on the roof and the extension 1330 is covered partially by the shingles or other roof material. The rolled screen locking bead 1320 helps secure the screened gutter protection system over the gutter. In FIG. 27, the molded feature of the screen 1310 over the louvers 1305 is demonstrated. This drawing further shows the slotted weep hole 1321 formed in the locking bead 1320. The sizes shown on the drawing are exemplary.

Gutter-Locking Gutter Protection System

A gutter-locking gutter protection system is described below that may be a gutter-locking screened system including a mesh, or screen, or a system without a screen.

Aspects of the present invention further provide a gutter protection product by providing an alternate design for fascia mount installations that do not require application beneath the roofing shingles. One exemplary type of this new fascia mount gutter cover version utilizes less material width than the original product and may also incorporate the less costly 40/40 stainless steel screen mesh.

Figure 31:
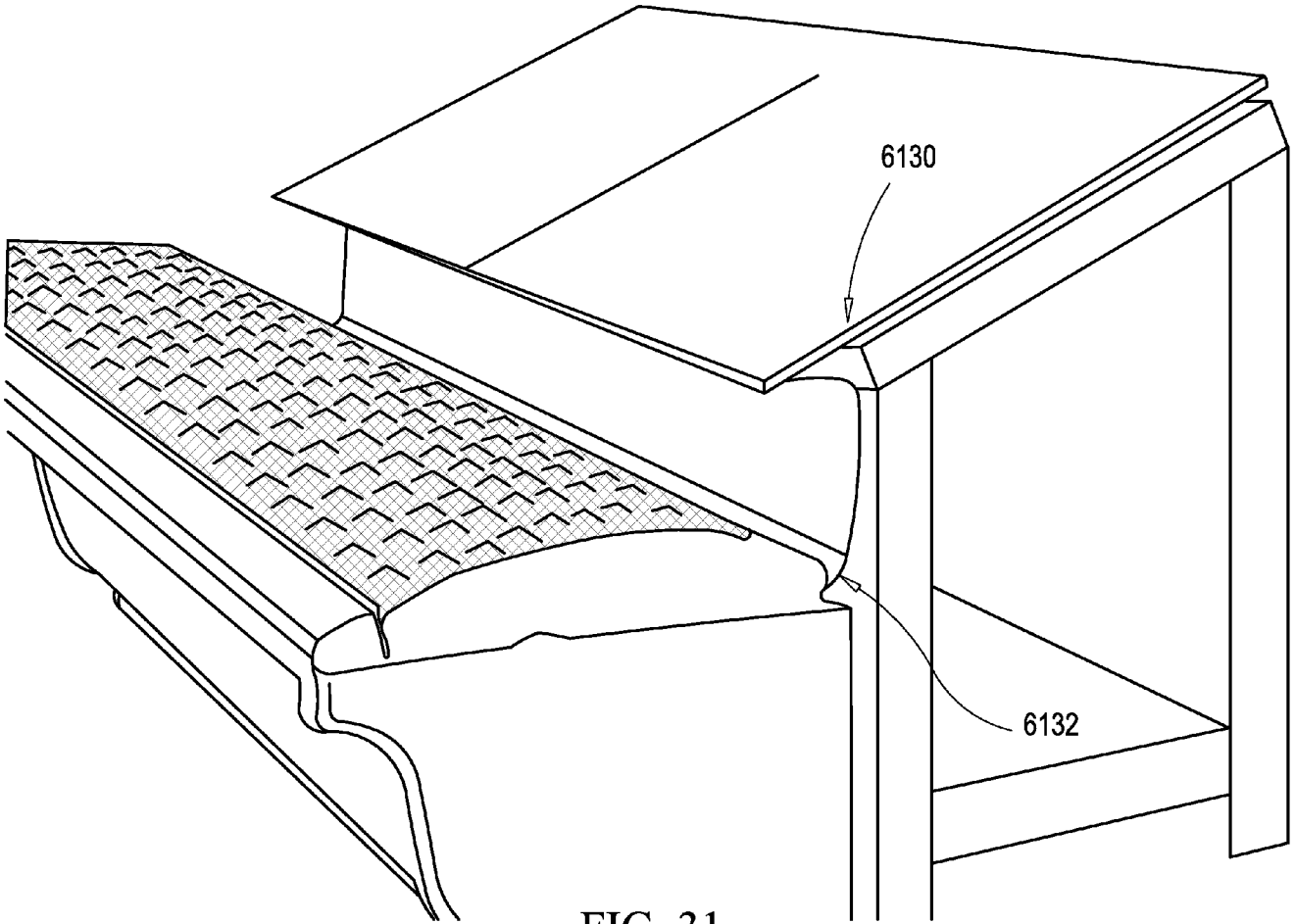
FIG. 31 shows another photograph of an exemplary installation of the gutter-locking gutter protection system of FIG. 28 or FIG. 29 on a roof, according to the aspects of the present invention.

As seen in FIGS. 18A and 18B, the previously described gutter protection system is installed with the back edge of the panel inserted under the roofing shingles. This type of installation helped ensure better performance of the system shown in FIGS. 18A and 18B. Further, FIG. 23 showed the installation of the previously described type of gutter protection product that is installed by insertion of an end of the product beneath the roofing shingles. On the other hand, FIG. 31 shows the alternate design, described below, where the edge of the gutter protection system need not be inserted beneath the shingles.

The gutter-locking gutter protection system features include the following:

1) It may be used to reduce the overall coil strip width as a cost savings initiative such that a 9" coil may be reduced to a 7.5" coil for a reduction of approximately 16.6%.

2) It may be capable of attaching to the 5K gutter and fascia without fasteners.

3) It is capable of being produced on existing roll formers with some tool modifications.

4) It provides a sloping top to allow debris to roll off.

5) It is capable of utilizing existing screen mesh material size.

6) It may also be functional without screen with louvers closed up to 50%.

Additional roll form tooling may be added to manufacture a screened gutter cover version with a corrugated safety edge that locks to the fascia on top of the gutter for both 5K and 6K Gutters. For example, an existing Micro-CS™ panel roll forming line may be augmented by removing part of the existing panel tooling and installing the alternate optional new roll form tooling on the same base to fabricate a product according to the aspects of the present invention.

Figures 28A, 28B:
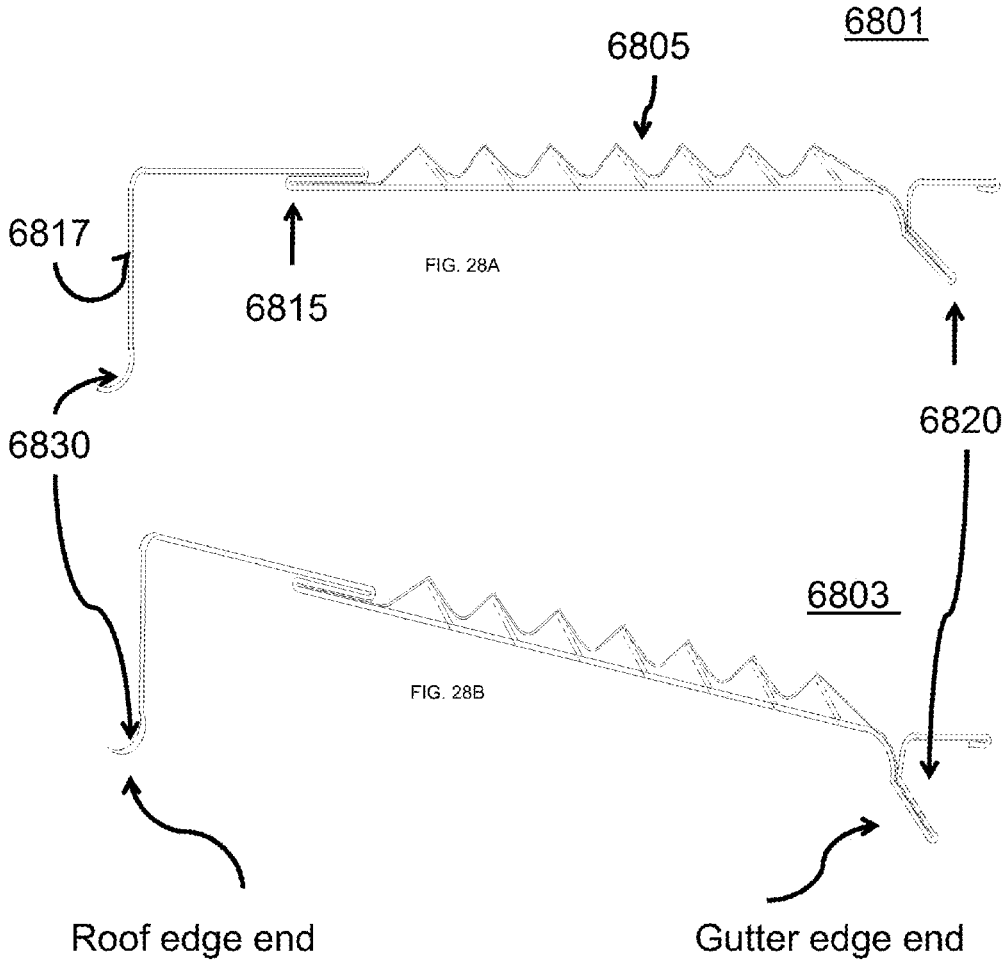
FIGS. 28A and 28B show a schematic drawing of an exemplary gutter-locking gutter protection system, according to aspects of the present invention.
Figure 29A:
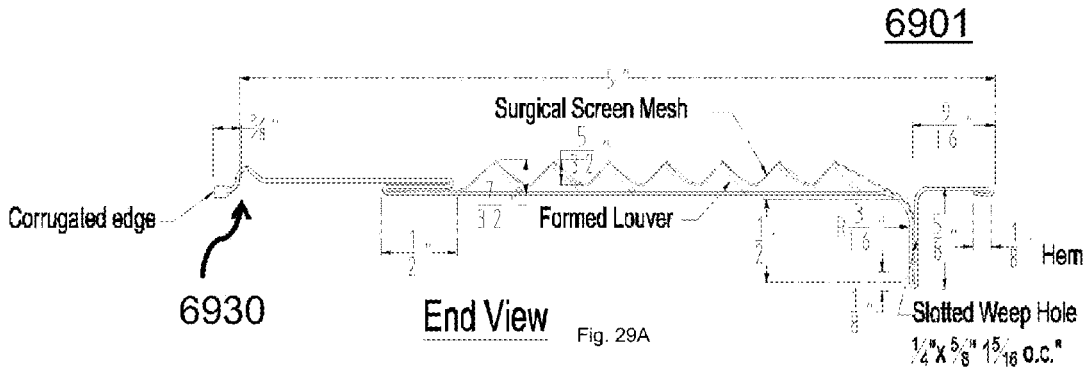
FIGS. 29A, 29B, 29C and 29D show a schematic drawing of a gutter-locking screened gutter protection system including exemplary measurements, according to the aspects of the present invention.
Figure 29B:
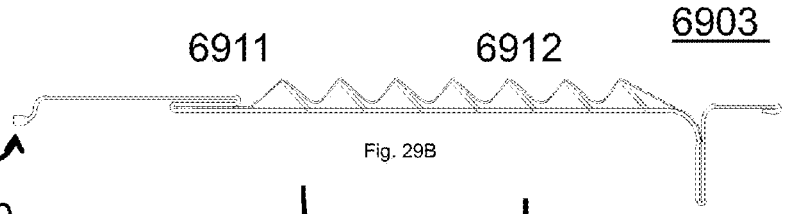
Figure 29C:
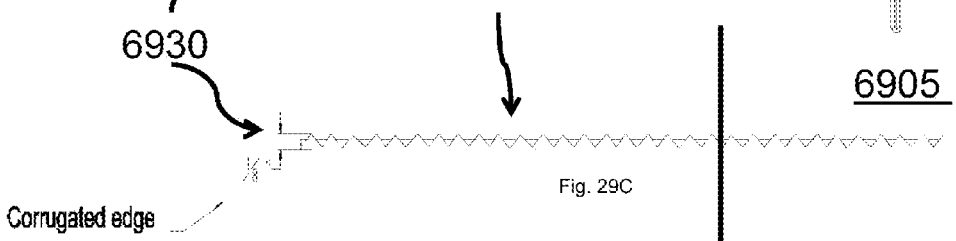
Figure 29D:
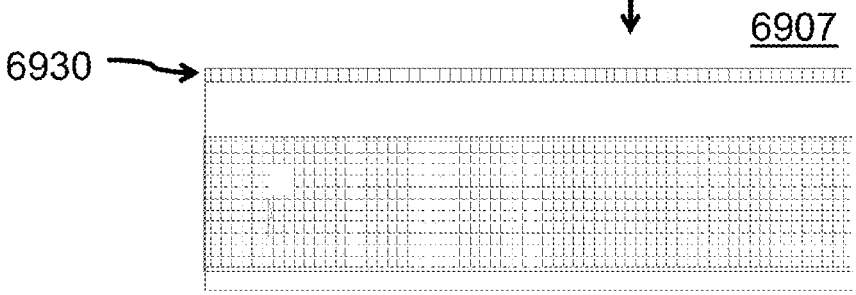

FIGS. 28A and 28B show a schematic drawing of an exemplary gutter-locking gutter protection system, according to aspects of the present invention.

Two systems 6801 and 6803 are shown. Each of the gutter protection systems 6801 and 6803 includes a panel portion that may be connected to a filter or screen. The panel portion includes louvered rows 6805. The louvered rows may be covered by a screen, which is molded over the louvers. The panel 6801 ends in one locking mechanism 6820 at one end and another locking mechanism 6830 at the other end. The locking mechanism 6820 attaches to the edge of the gutter and may be similar to the hanger bracket described above. The locking mechanism 6830 is a corrugated edge and is placed under the roof but is not slid under the shingles. A connecting portion 6817 of the panel 6801 extends between the louvered portion 6805 and the corrugated edge 6830.

The system 6801 has a panel surface substantially parallel to a top surface of the gutter. Doming of the louvered panel may be used to create a slope that deters the collection of the debris on top. The system 6803 has a sloped surface that, upon installation, slopes from the roof toward the edge of the gutter. The sloped surface of 6803 causes debris to roll off more easily.

The gutter-locking gutter protection system shown in FIG. 28A may be manufactured without a screen or filter if the louvers are manufactured to be relatively closed, such as up to 50% or more closed. Further, the sloping surface of the gutter protection system reduces the need for having a mesh or a screen over the louvers. Where a screen is present, it may be tied to the panel by a rolling lock bead 6815.

In FIGS. 28A and 28B, the connecting portion 6817 is shown as substantially perpendicular to the louvered portion 6805 and to the corrugated edge 6830 for panel 6801. For the sloped panel 6803, the connecting portion 6817 forms an angle smaller than 90 degrees with the surface of the louvered portion. Note that in both exemplary embodiments, the connecting portion is shown to bend downward from the surface of the panel to fit over a gutter. However, in FIG. 31, the exemplary installation shown bends the connecting portion upward from the surface of the panel in the louvered portion in order to fit the corrugated edge under the edge of the roof. The panel can be bent such that the connecting portion bends up or down with respect to the louvered portion. The bending depends on whether the panel is being fitted over both lips of the gutter or whether one edge of the panel is locking to the far lip of the gutter while the corrugated edge is being fitted under a roof edge.

FIGS. 29A, 29B, 29C and 29D show a schematic drawing of a gutter-locking gutter protection product including exemplary measurements, according to the aspects of the present invention.

Four views are provided in FIGS. 29A, 29B, 29C and 29D. View 6901 provides a cross-sectional view of the product showing exemplary measurements and sizes for one implementation. The dimensions are in units of inch. View 6903 provides the same cross-sectional view with the location of the two additional views 6905 and 6907 being marked on the cross section. View 6905 corresponds to the cross section 6911 on view 6903 and shows the louvers under the screen mesh. View 6907 corresponds to the cross section 6912 and shows a plan view of the product.

In all of the various views shown on FIGS. 29A, 29B, 29C and 29D, the corrugated edge is shown as 6930.

Figure 30:
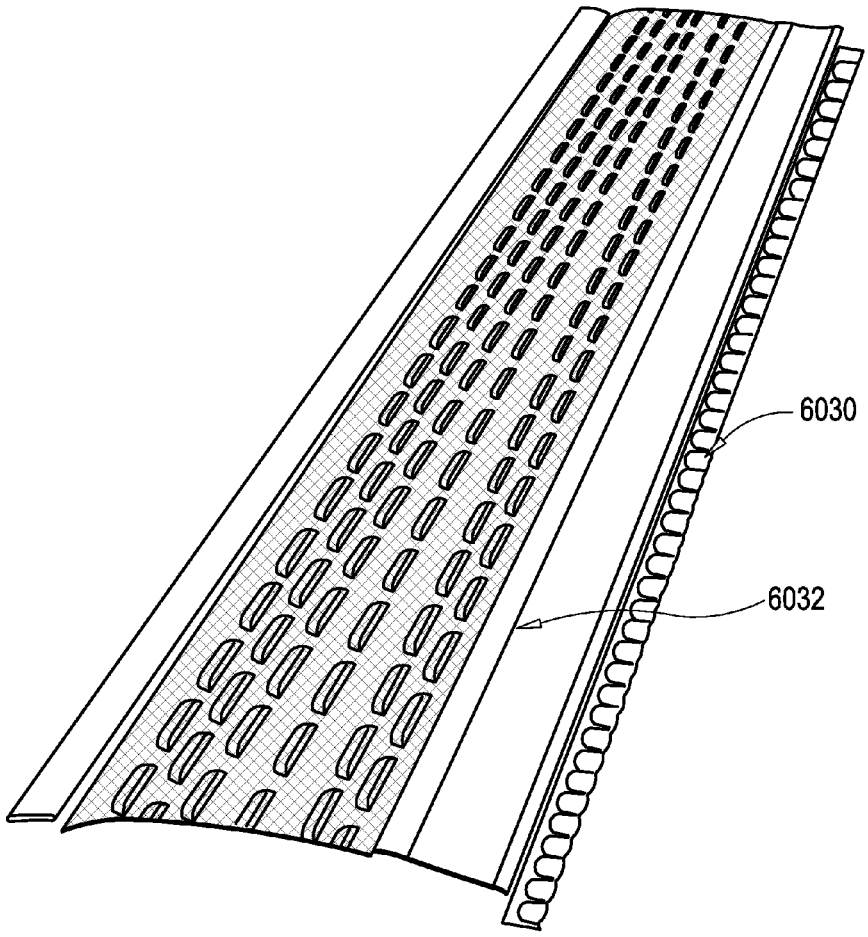
FIG. 30 shows a photograph of an exemplary implementation of the gutter-locking gutter protection system of FIG. 28 or FIG. 29, according to the aspects of the present invention.

FIG. 30 shows a photograph of an exemplary implementation of the gutter-locking gutter protection product of FIG. 28 or FIG. 29, according to the aspects of the present invention.

The corrugated edge 6030 is used on the side of the product that is installed at or attached to the roof. At the time of installation, the gutter protection product is bent at 6032 and again at the corrugated edge 6030 to fit the product under the edge of the roof.

FIG. 31 shows another photograph of an exemplary installation of the gutter-locking gutter protection product of FIG. 28 or FIG. 29 on a roof, according to the aspects of the present invention.

FIG. 31 shows a corrugated edge 6130 in relationship with the roof after installation. As shown in this drawing, there is no need to insert the corrugated edge 6130 under the shingles. Rather, the corrugated edge merely sits under the overhang of the roof. FIG. 31 shows the bending at 6132 and at the corrugated edge 6130 that helps fit the product under the edge of the roof.

The exemplary products shown in FIG. 30 and FIG. 31 have a domed surface rather than a sloping surface. A sloping surface would slope from the edge of the roof downward toward the outer edge of the gutter. Further, the products shown in FIG. 30 and FIG. 31 are screened such that the louvers of the panel are covered by a mesh or a screen that is molded onto the shape of the louvers. As explained above, screening is not required for all embodiments.

The features of the gutter-locking gutter protection system shown in FIG. 28 through FIG. 31 may be combined with various features of the gutter lock shown in FIG. 1 through FIG. 14 and the screened gutter protection shown in FIG. 15A through FIG. 27 to arrive at a multitude of embodiments.

The present invention has been described in relation to particular examples, which are intended to be illustrative rather than restrictive, with the scope and spirit of the invention being indicated by the following claims and their equivalents.

The invention claimed is:

1. A system for protection of a gutter from debris collection, the system comprising:

a panel extending from an edge of a roof to an outer lip of the gutter installed around the edge of the roof, the panel including:

a louvered portion including louvers for providing openings to the gutter below;

a corrugated edge adapted for fitting under the edge of the roof and lying substantially parallel to the edge of the roof upon installation, the corrugated edge being further adapted for fitting over an inner lip of the gutter;

a gutter lock for locking the panel to the outer lip of the gutter, the gutter lock comprises a bracket for affixing the panel over the gutter, the bracket comprising:

a long arm;

a short arm extending from a junction with and generally perpendicular relative to said long arm;

a gutter support flange extending at an acute angle from an end of the short arm, said gutter support flange having at least one depending flange to strengthen the bracket against bending;

an outwardly and downwardly extending gripping tab in said short arm beneath said junction, wherein said gripping tab on said short arm holds a rainwater deflector to said bracket; and an outwardly and upwardly extending trapping tab in said short arm beneath said junction for trapping the rainwater deflector, wherein the long arm is mounted on the surface of building; and a connecting portion leading from the louvered portion to the corrugated edge, wherein the connecting portion is adapted for being bent to form a substantially right angle with the corrugated portion, and wherein the connecting portion is adapted for being bent to form an angle with the louvered portion upon the installation of the panel over the gutter.

2. The system of claim 1, wherein a surface of the louvered portion is substantially sloped downward from the edge of the roof toward the outer lip of the gutter.

3. The system of claim 1, wherein the openings have a substantially vertical opening portion.

4. The system of claim 1, further comprising:

a screen connected to the panel, wherein the screen is molded over the louvered portion.

5. The system of claim 4, wherein the panel further includes:

a first hemmed portion for connecting a first edge of the screen to the panel, and a second hemmed portion for connecting a second edge of the screen to the panel, wherein the panel is made from a continuous sheet, and wherein beads are rolled onto the first hemmed portion and the second hemmed portion.

6. The system of claim 5, the screen is made from 40/40 stainless steel screen mesh and the panel is made from 7.5" coil.

7. The system of claim 1, wherein the louvers are arranged in offset rows of louvers.

8. The system of claim 1, wherein the louvered portion of the panel is dome-shaped.

9. The system of claim 1, wherein the corrugated edge is adapted for locking to fascia on top of the gutter for both 5K and 6K gutters.

10. A screened gutter protection device for being mounted on a roof and fitting over a gutter on a roof and for protecting the gutter from collection of debris, the device comprising:

a panel including louvers, the louvers having openings in a louvered portion of the panel; and a filter screen set in hemmed portions on opposing sides of the panel and secured to the panel by rolled screen locking beads at the hemmed portions, wherein the panel includes:

a corrugated edge adapted for fitting under an edge of the roof and lying substantially parallel to the edge of the roof upon installation, the corrugated edge being further adapted for fitting over an inner lip of the gutter, a gutter lock for locking the panel to the outer lip of the gutter the gutter lock comprises a bracket for affixing the panel over the gutter, the bracket comprising:

a long arm;

a short arm extending from a junction with and generally perpendicular relative to said long arm;

a gutter support flange extending at an acute angle from an end of the short arm, said gutter support flange having at least one depending flange to strengthen the bracket against bending;

an outwardly and downwardly extending gripping tab in said short arm beneath said junction, wherein said gripping tab on said short arm holds a rainwater deflector to said bracket; and an outwardly and upwardly extending trapping tab in said short arm beneath said junction for trapping the rainwater deflector, wherein the long arm is mounted on the surface of building, and a connecting portion leading from the louvered portion to the corrugated edge, wherein the connecting portion is adapted for being bent to form a first angle with the corrugated portion and a second angle with the louvered portion upon the installation of the panel over the gutter.

11. The device of claim 10, wherein a surface of the panel slopes from the edge of the roof downward to the outer lip of the gutter.

12. The device of claim 10, wherein the panel further includes:

a first rolled screen locking bead for holding a first edge of the filter screen to the panel, and a second rolled screen locking bead for holding a second edge of the filter screen to the panel.

13. The device of claim 12, wherein the panel is dome shaped in the louvered portion and the filter screen is convex, wherein the louvers are arranged in offset rows of louvers, wherein the filter screen is fitted over the louvered portion, wherein the panel is made from a continuous sheet of material, and wherein the filter screen is made from stainless steel micro mesh.

14. A method for making a screened gutter protection system, the method comprising:

forming a panel; and attaching a screen to the panel, wherein the panel extends from an edge of a roof to an outer lip of the gutter installed around the edge of the roof, and wherein the panel is formed by including:

a louvered portion having louvers for providing openings to the gutter below;

a corrugated edge adapted for fitting under the edge of the roof and lying substantially parallel to the edge of the roof upon installation, the corrugated edge being further adapted for fitting over an inner lip of the gutter;

a gutter lock for locking the panel to the outer lip of the gutter the gutter lock comprises a bracket for affixing the panel over the gutter, the bracket comprising:

a long arm;

a short arm extending from a junction with and generally perpendicular relative to said long arm;

a gutter support flange extending at an acute angle from an end of the short arm, said gutter support flange having at least one depending flange to strengthen the bracket against bending;

an outwardly and downwardly extending gripping tab in said short arm beneath said junction, wherein said gripping tab on said short arm holds a rainwater deflector to said bracket; and an outwardly and upwardly extending trapping tab in said short arm beneath said junction for trapping the rainwater deflector, wherein the long arm is mounted on the surface of building; and a connecting portion leading from the louvered portion to the corrugated edge, wherein the connecting portion is adapted for being bent to form angles with the corrugated portion and the louvered portion upon installation of the panel over the gutter.

15. The method of claim 14, further comprising:

molding the screen to the louvered portion of the panel.

16. The method of claim 14, wherein the attaching of the screen to the panel comprises:

laying a first side of the screen in a first hemmed portion of the panel and a second side of the screen in a second hemmed portion of the panel; and rolling beads onto the hemmed portions.

17. The method of claim 14, wherein the panel is formed from a continuous sheet of material.

18. The method of claim 14, wherein the panel is dome shaped in the louvered portion and the filter screen is convex, and wherein the louvers are arranged in offset rows of louvers.

19. A method of installing a gutter protection system for a gutter, the method comprising:

determining a type and a size of the gutter;

determining a required number of gutter protection components; and installing the gutter protection components to form the gutter protection system, wherein the gutter protection system includes:

a panel extending from an edge of a roof to an outer lip of the gutter installed around the edge of the roof, the panel including:

a louvered portion including louvers for providing openings to the gutter below;

a corrugated edge adapted for fitting under the edge of the roof and lying substantially parallel to the edge of the roof upon installation, the corrugated edge being further adapted for fitting over an inner lip of the gutter;

a gutter lock for locking the panel to the outer lip of the gutter the gutter lock comprises a bracket for affixing the panel over the gutter, the bracket comprising:

a long arm;

a short arm extending from a junction with and generally perpendicular relative to said long arm;

a gutter support flange extending at an acute angle from an end of the short arm, said gutter support flange having at least one depending flange to strengthen the bracket against bending;

an outwardly and downwardly extending gripping tab in said short arm beneath said junction, wherein said gripping tab on said short arm holds a rainwater deflector to said bracket; and an outwardly and upwardly extending trapping tab in said short arm beneath said junction for trapping the rainwater deflector, wherein the long arm is mounted on the surface of building; and a connecting portion leading from the louvered portion to the corrugated edge, wherein the connecting portion is adapted for being bent to form angles with the corrugated portion and the louvered portion upon the installation of the panel over the gutter.

* * * * *